US011280129B2

(12) United States Patent
Ferrer Garcia

(10) Patent No.: US 11,280,129 B2
(45) Date of Patent: Mar. 22, 2022

(54) WINDOWS ACCESSING MORE SKY

(71) Applicant: Aldana Florencia Ferrer Garcia, Brooklyn, NY (US)

(72) Inventor: Aldana Florencia Ferrer Garcia, Brooklyn, NY (US)

( * ) Notice: Subject to any disclaimer, the term of this patent is extended or adjusted under 35 U.S.C. 154(b) by 0 days.

(21) Appl. No.: 17/139,156

(22) Filed: Dec. 31, 2020

(65) Prior Publication Data

US 2021/0123289 A1 Apr. 29, 2021

Related U.S. Application Data

(62) Division of application No. 16/234,837, filed on Dec. 28, 2018, now Pat. No. 10,914,113, which is a division of application No. 15/378,512, filed on Dec. 14, 2016, now Pat. No. 10,167,663.

(60) Provisional application No. 62/386,980, filed on Dec. 18, 2015.

(51) Int. Cl.

| | |
|---|---|
| ***E06B 1/36*** | (2006.01) |
| ***E04B 1/00*** | (2006.01) |
| ***E06B 3/48*** | (2006.01) |
| ***E06B 7/28*** | (2006.01) |

(52) U.S. Cl.

CPC ..... *E06B 1/36* (2013.01); *E04B 1/003* (2013.01); *E06B 3/48* (2013.01); *E06B 7/28* (2013.01)

(58) Field of Classification Search

CPC ..... E04B 1/344; E04B 1/003; E04B 1/34357; E06B 1/36; E06B 3/48; E06B 7/28

See application file for complete search history.

(56) References Cited

U.S. PATENT DOCUMENTS

| | | | | |
|---|---|---|---|---|
| 1,134,635 | A | 4/1915 | Osbron | |
| 1,152,899 | A | 9/1915 | Moore | |
| 1,214,057 | A | 1/1917 | Moore | |
| 1,259,795 | A | 3/1918 | Smith | |
| 1,380,237 | A | 5/1921 | Neff | |
| 1,448,235 | A | 3/1923 | Read | |
| 1,869,104 | A * | 7/1932 | Jay | E04B 1/003 52/32 |
| 2,044,030 | A | 6/1936 | Madison | |

(Continued)

FOREIGN PATENT DOCUMENTS

| | | |
|---|---|---|
| DE | 10013004 A1 | 1/2001 |
| DE | 19930679 A1 | 1/2001 |

(Continued)

OTHER PUBLICATIONS

U.S. Appl. No. 16/234,837, filed Dec. 28, 2018, US-2019/0136605, Allowed.

(Continued)

*Primary Examiner* — Rodney Mintz
(74) *Attorney, Agent, or Firm* — Alston & Bird

(57) ABSTRACT

A window with multiple elements which are suitable for installation in a building exterior wall as part of designing and/or retrofitting building facades is disclosed. The building structure comprises one or more movable members movably attached to a frame member where the frame member is secured in a wall opening. The building structure may further comprise a sash member attached to the one or more movable members. The connection of these members may be such that an enclosure is created when the building structure is in an extended or open position.

13 Claims, 29 Drawing Sheets

(56) References Cited

U.S. PATENT DOCUMENTS

| | | | | |
|---|---|---|---|---|
| 3,127,697 | A | 4/1964 | Romenko | |
| 3,148,479 | A | 9/1964 | Cyrus | |
| 3,319,378 | A * | 5/1967 | Andrews | E06B 7/28 47/40 |
| 4,090,585 | A | 5/1978 | Laub | |
| 4,132,033 | A | 1/1979 | Esposito | |
| 4,498,374 | A * | 2/1985 | Gibson | F24F 13/32 454/204 |
| 4,565,265 | A | 1/1986 | Maier | |
| 5,598,665 | A * | 2/1997 | Guddas | E04B 1/003 49/404 |
| 5,625,982 | A * | 5/1997 | Foote | E04B 1/3211 52/64 |
| 6,745,519 | B2 * | 6/2004 | Edger | E06B 1/363 16/269 |
| 9,080,379 | B2 | 7/2015 | Guillemette | |
| 9,388,630 | B1 * | 7/2016 | Fitzthum | A01K 1/035 |
| 9,932,768 | B2 * | 4/2018 | Valinejadshoubi | E06B 3/40 |
| 10,167,663 | B2 | 1/2019 | Ferrer Garcia | |
| 10,914,113 | B2 * | 2/2021 | Ferrer Garcia | E06B 1/36 |
| 2003/0233794 | A1 * | 12/2003 | Pylkki | E06B 7/28 52/173.1 |
| 2012/0117882 | A1 * | 5/2012 | Guillemette | E05D 15/262 49/156 |
| 2016/0109150 | A1 * | 4/2016 | De Jesus | E06B 7/28 49/55 |
| 2016/0312525 | A1 | 10/2016 | Valinejadshoubi et al. | |
| 2017/0175379 | A1 * | 6/2017 | Ferrer Garcia | E06B 3/48 |
| 2017/0188542 | A1 * | 7/2017 | Dix | A01K 1/035 |
| 2017/0275937 | A1 | 9/2017 | Park | |
| 2018/0001218 | A1 | 1/2018 | Sinn et al. | |

FOREIGN PATENT DOCUMENTS

| | | | |
|---|---|---|---|
| EP | 1644591 | B1 | 1/2008 |
| WO | WO 2004/109024 | A1 | 12/2004 |
| WO | WO-2010/136187 | A1 | 12/2010 |

OTHER PUBLICATIONS

U.S. Appl. No. 15/378,512, filed Dec. 14, 2016, U.S. Pat. No. 10/167,663, Issued.

"Designboom: Dubai Design Week's Global Grad Show: Aldana Ferrer Garcia Presents 'More Sky'." [Retrieved Feb. 24, 2017]; Retrieved from the Internet: <URL: http://www.designboom.com/design/dubai-design-week-global-grad-showaldana-ferrer-garcia-more-sky-10-31-2015/>, (dated Nov. 1, 2015) 23 pages.

"MoreSky by Aldana Ferrer Garcia | lefilrougeblog.com" [retrieved Feb. 27, 2017] Retrieved from the Internet: <URL: http://lefilrougeblog.com/architecture/moresky-by-aldana-ferrer-garcia/>; (dated Nov. 25. 2015), 7 pages.

"MoreSky Video 02 small—Youtube." (retrieved May 2, 2017); Retrieved from the Internet: <URL: https://www.youtube.com/watch?v=3BsDKGCOB7g>. (dated Jun. 13, 2015), 3 pages.

International Search Report and Written Opinion for International Patent Application No. PCT/US2016/067208 dated Mar. 8, 2017, 13 pages.

Office Action for European Application No. 16834143.6 dated Feb. 24, 2020.

Office Action for European Application No. 16834143.6 dated Mar. 19, 2019, 8 pages.

Second Written Opinion for International Application No. PCT/US2016/067208 dated Nov. 24, 2017, 7 pages.

* cited by examiner

WINDOWS ACCESSING MORE SKY

PRIORITY CLAIM

This application is a divisional application of U.S. patent application Ser. No. 16/234,837 filed Dec. 28, 2018, now U.S. Pat. No. 10,914,113, which in turn was a divisional application of U.S. patent application Ser. No. 15/378,512 filed Dec. 14, 2016, now U.S. Pat. No. 10,167,663, which claims the benefit under 35 U.S.C. § 119(e) of U.S. Provisional Application No. 62/386,980 filed on Dec. 18, 2015, entitled "BUILDING STRUCTURE," the disclosure of which is hereby incorporated by reference.

FIELD OF THE INVENTION

The present invention relates to the field of window systems and, more particularly, to window systems, assemblies, and associated structures that extend outward from a building's walls to form additional useable shielded space beyond the exterior line of a building's facade.

BACKGROUND OF THE INVENTION

Window systems may provide an opening in the outer walls of a building to admit light and/or air into the interior of the structure. Additionally, window systems may provide occupants an outside view, as well as a sense of an enlarged space. However, conventional window systems generally restrict a building's occupants from accessing the exterior, and restrict occupants from physically placing themselves comfortably and safely beyond a building's facade. The present invention allows a building's occupants to do so, and to gain additional useable space as well an expanded field of view. As the world becomes more densely populated with living and commercial spaces, including residences, homes, dwellings, and businesses becoming more confined, urban and suburban space being at a premium, and building codes preventing or restricting the creation of a balcony or other similar permanent structures from extending beyond a building's facade, structures and means to enlarge a space beyond the exterior line of a building to permit an occupant to safely and readily take advantage of such added exterior space are needed.

Some configurations of structures found in the prior art attempt to mitigate these problems, but each fail to provide a solution to the above identified problems. U.S. Pat. No. 1,259,795 to Smith discloses an open sleeping balcony which may be attached and erected directly to the outside of a house over an existing window or door opening. In Smith, an open lattice framed structure is disclosed that attaches directly to the exterior wall of a home over an existing window, and continuously extends from the exterior wall beyond the exterior line of the building in which it is installed. U.S. Pat. No. 1,134,635 to Osbron discloses a folding window balcony which may be permanently attached to a building's exterior supported outside of a window and partly upon an exterior ledge. This structure is separate from the window system including but not limited to the frame, sill, jambs, and head of the window. In Osbron, the folding window provides an open air, open balcony supported permanently by the building's outer wall, positioned outside a window, and extendable beyond the exterior line of the building balcony. The prior art fails to provide an integrated, extendable, or expanding structure housed as part of a window system which can be extended beyond the exterior line of the facade of a building allowing users to safely and comfortably position themselves beyond the building's facade to take advantage of added space and experience the outdoors. Through applied effort, ingenuity, and innovation, many of these identified problems have been solved by developing solutions that are included in embodiments of the present disclosure, many examples of which are described in detail herein.

BRIEF SUMMARY OF THE INVENTION

Conventional windows are typically limited to having window panes that move up, down, left, or right, or rotate open and remain fixed to, or within, the structure of which they are a part. While such conventional windows admit light and sometimes air from the exterior into an interior space, they do not extend beyond a building's exterior wall/facade and do not provide a largely enclosed space beyond the facade of the structure that a person can use and/or even occupy.

Embodiments of the present invention provide an enclosed and/or shielded space beyond the facade of the structure that a person can use and/or occupy. In general, embodiments of the present invention, are disclosed herein rotating, extending, and/or swinging away from the facade of the structure, and provide usable enclosed or shielded space beyond the facade that a person can use and/or occupy.

BRIEF DESCRIPTIONS OF THE DRAWINGS

Having thus described the invention in general terms, reference will now be made to the accompanying drawings, which are not necessarily drawn to scale, and wherein:

Figure 3:
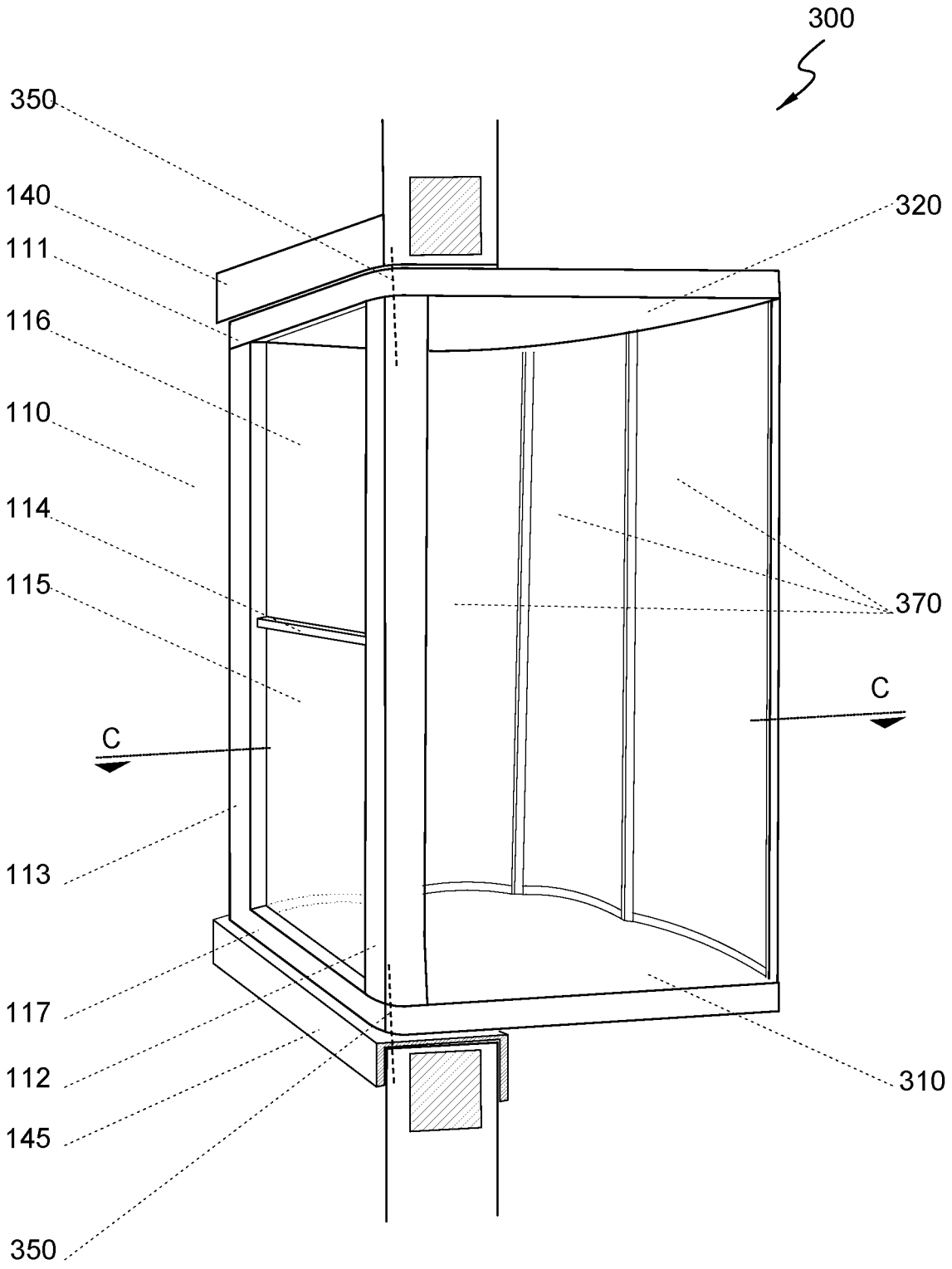
FIG. 3 illustrates a perspective view of a closed casement according to an alternative example embodiment of the present disclosure.
Figure 8:
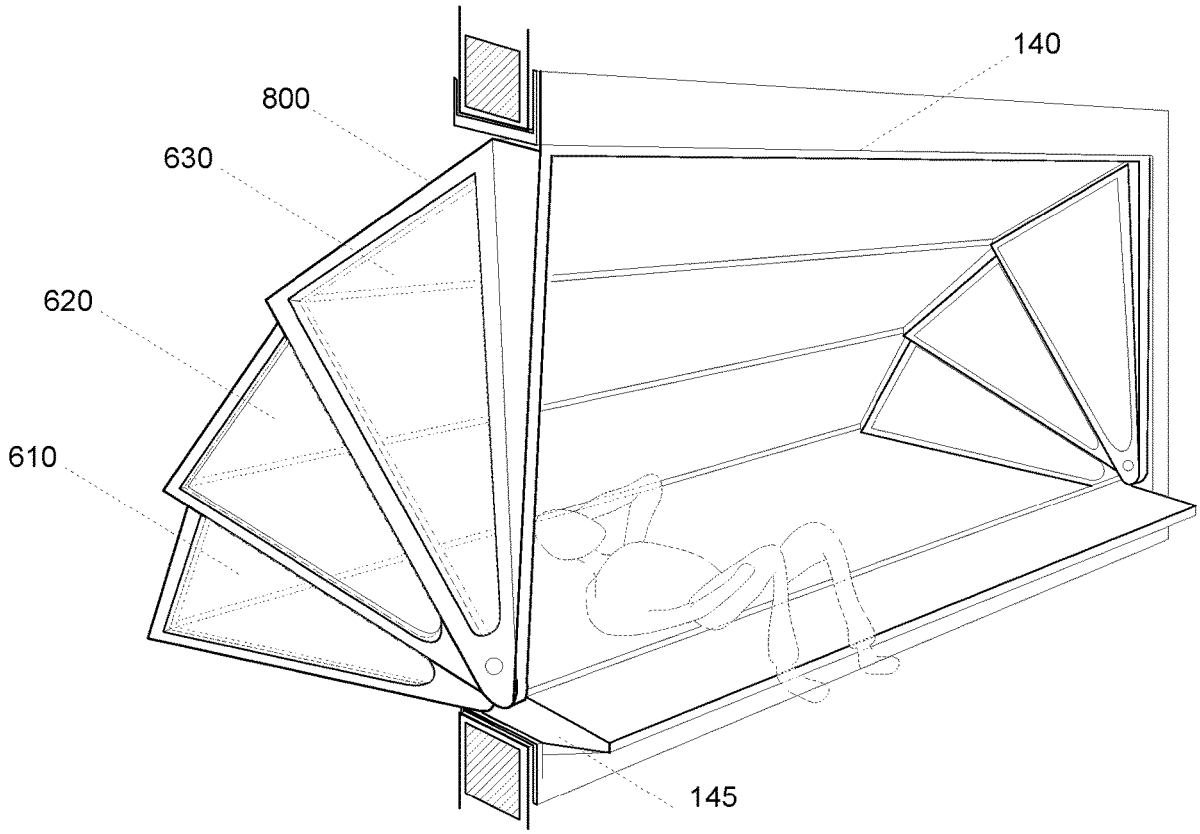
FIG. 8 illustrates an interior view of a large open hopper embodiment of the present disclosure.
Figure 13:
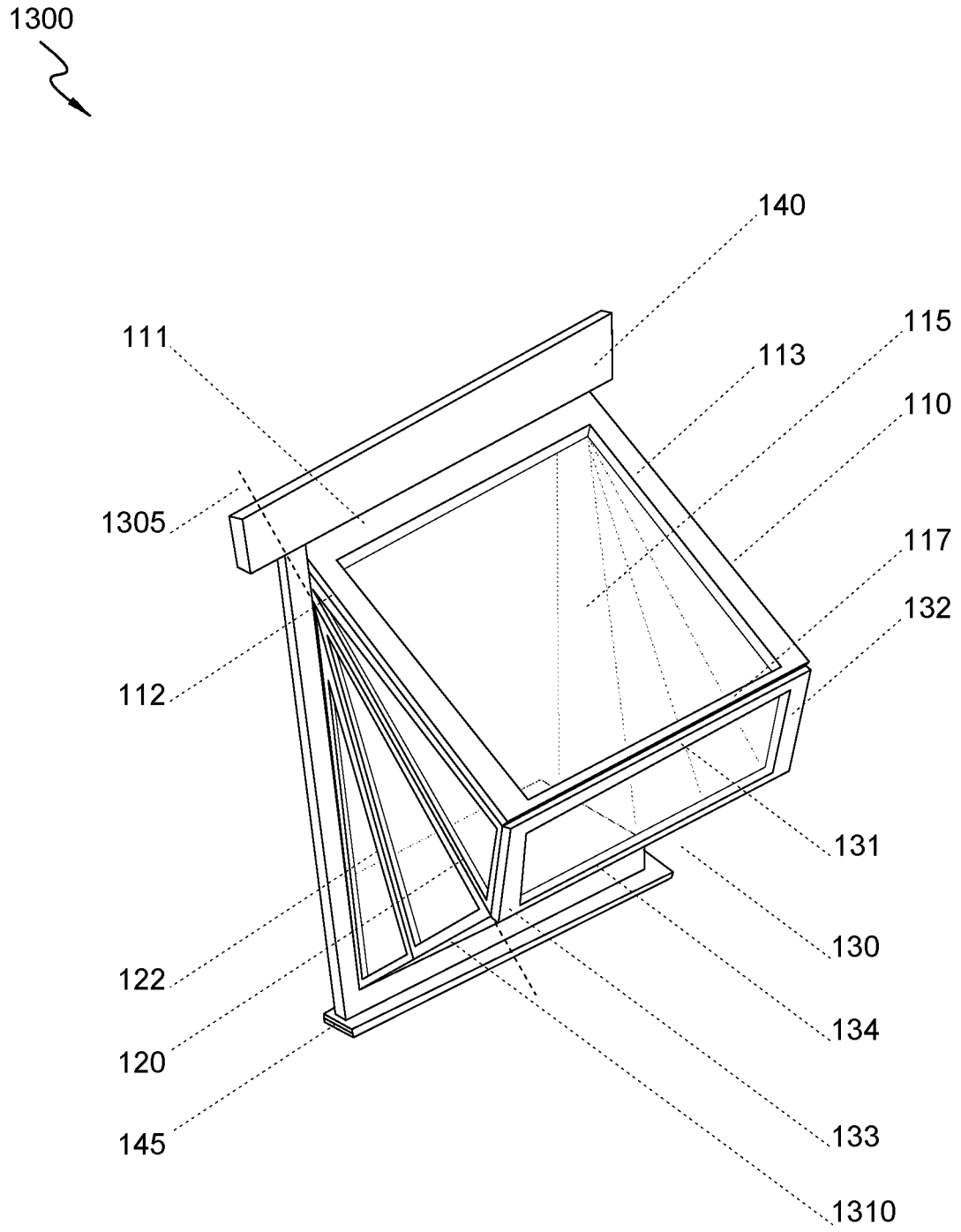
FIG. 13 illustrates a perspective view of a further open awning embodiment of the present disclosure.
Figure 14A:
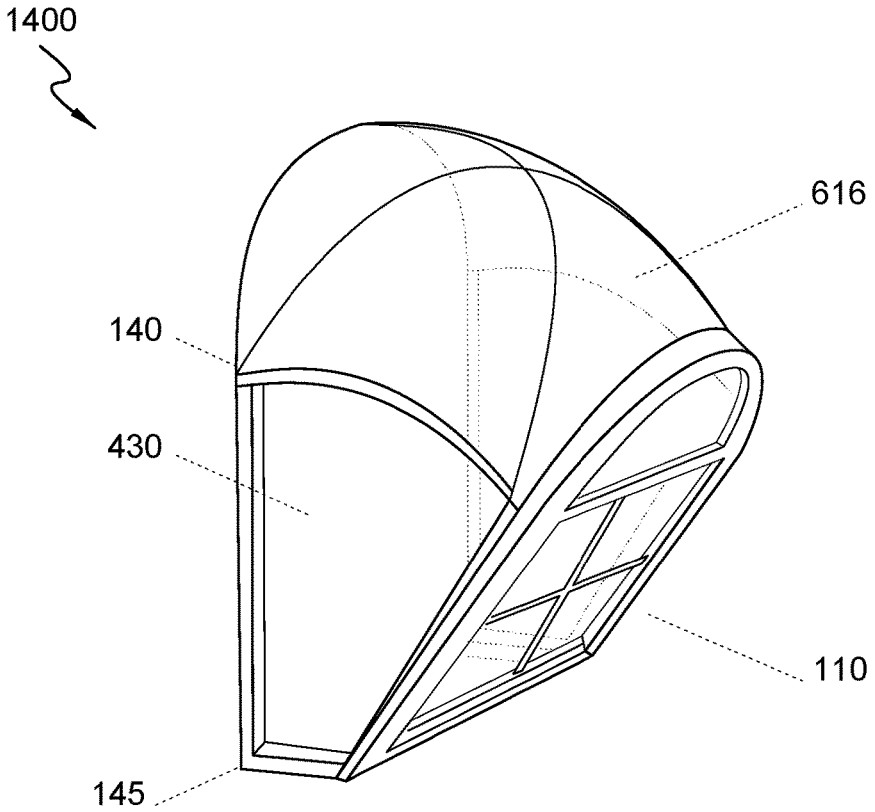
Figure 14B:
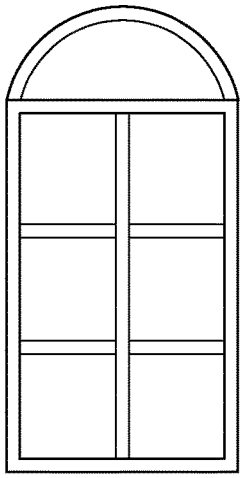
Figure 14C:
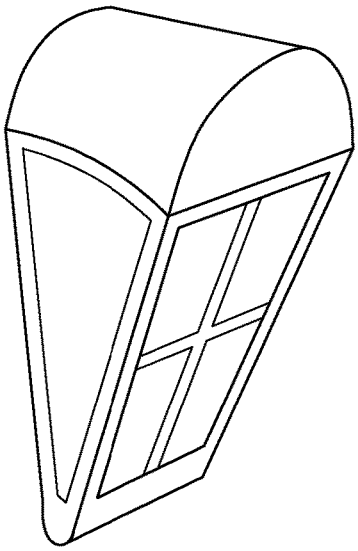
Figure 15A:
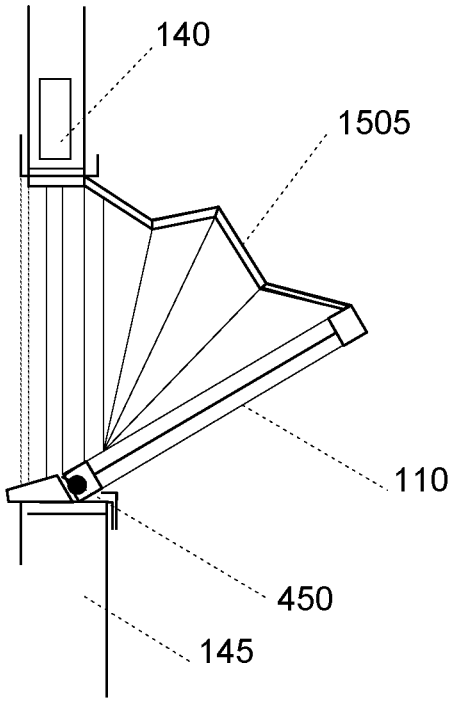
Figure 15B:
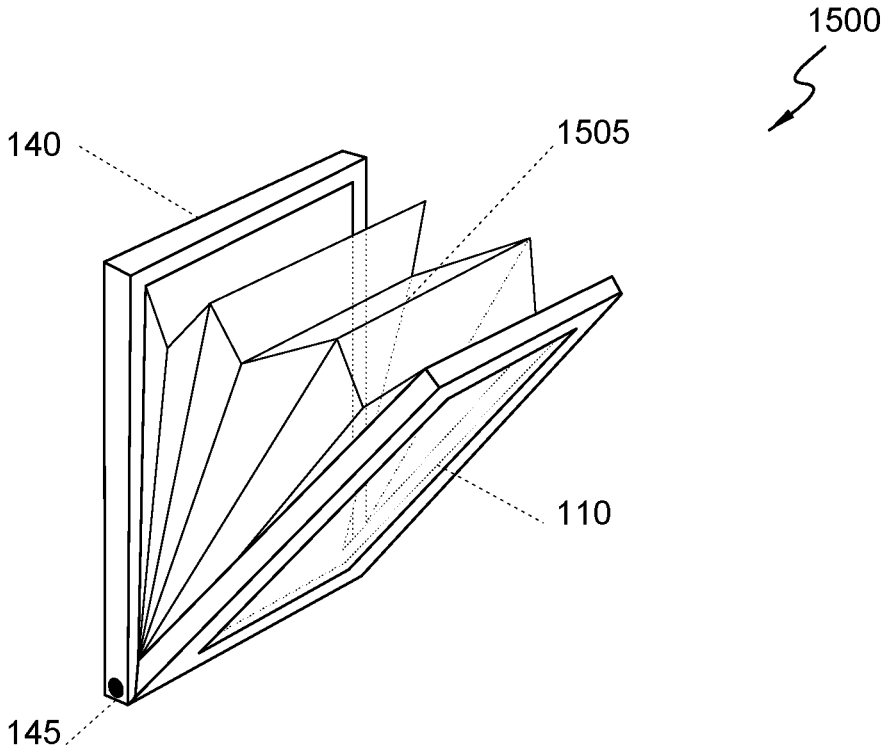
Figure 16A:
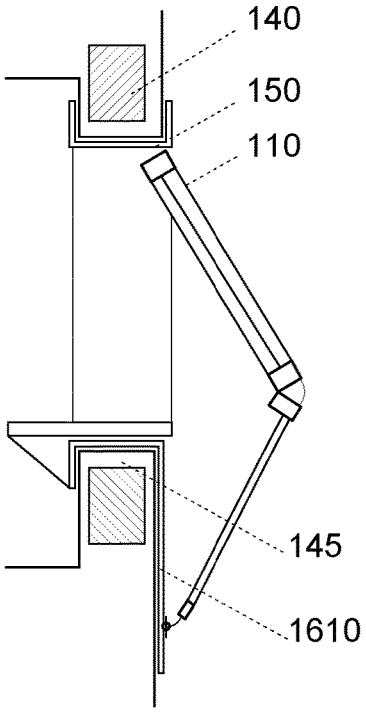
Figure 16C:
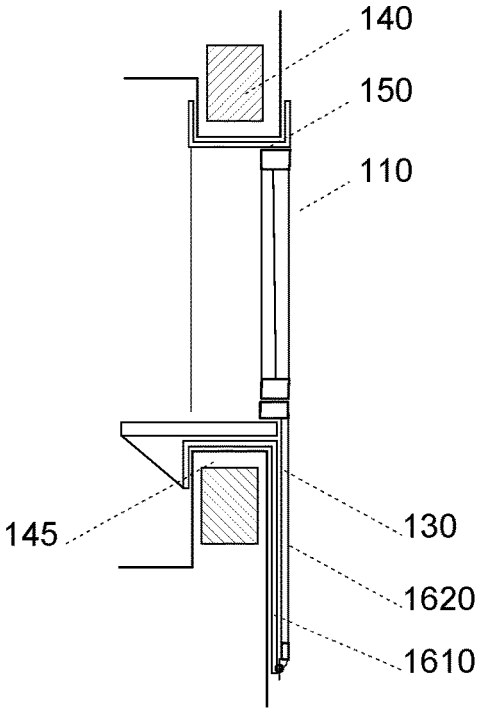
Figure 16B:
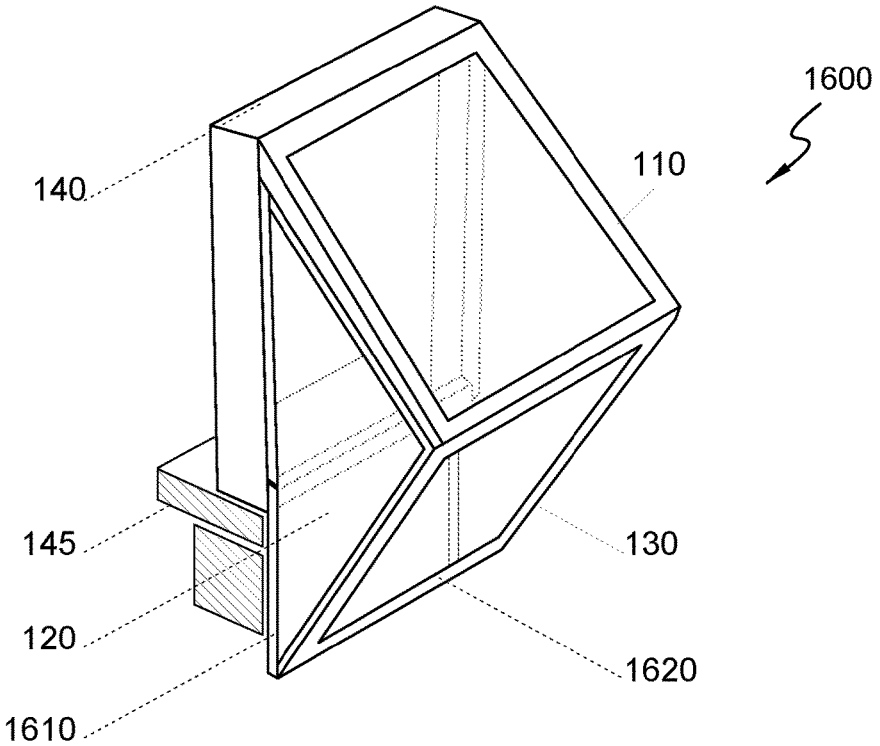
Figure 17A:
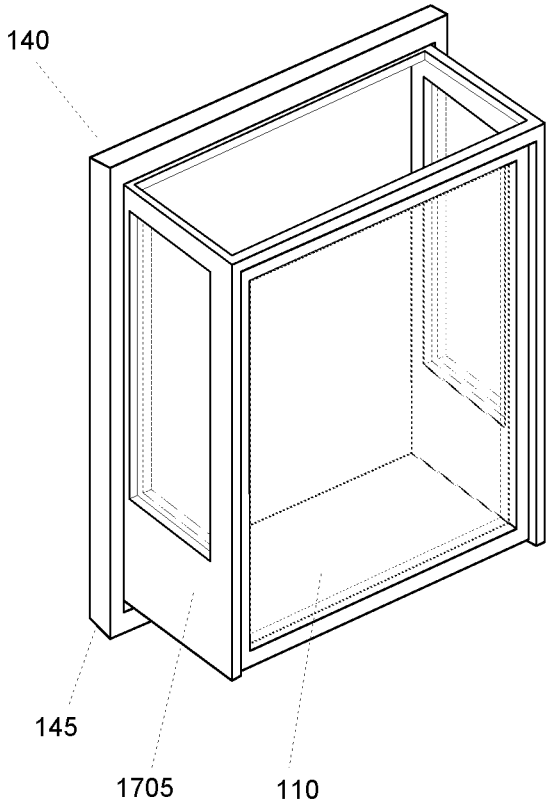
Figure 17B:
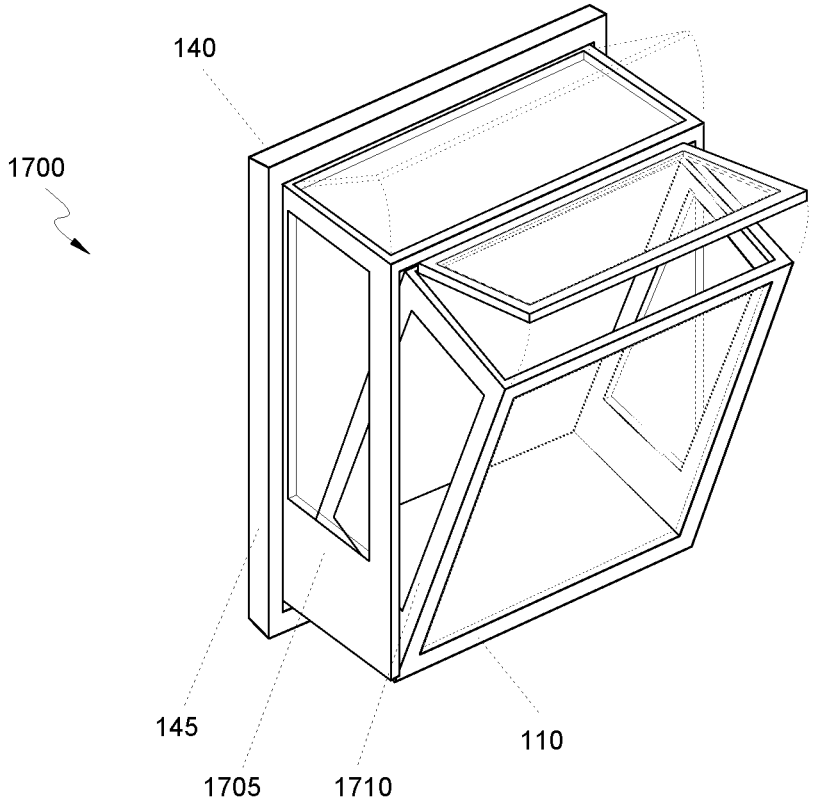
Figure 17C:
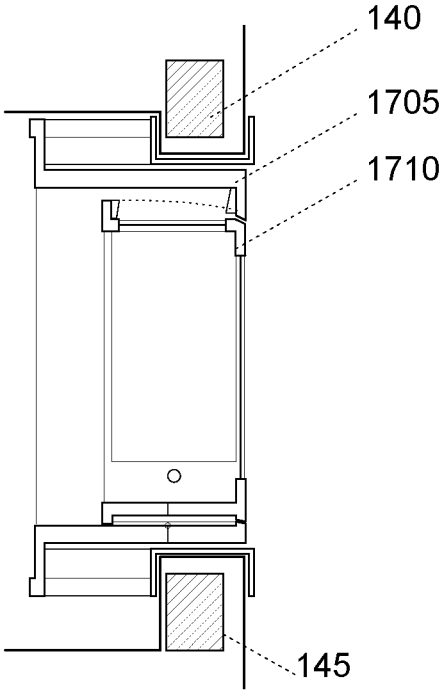
Figure 17D:
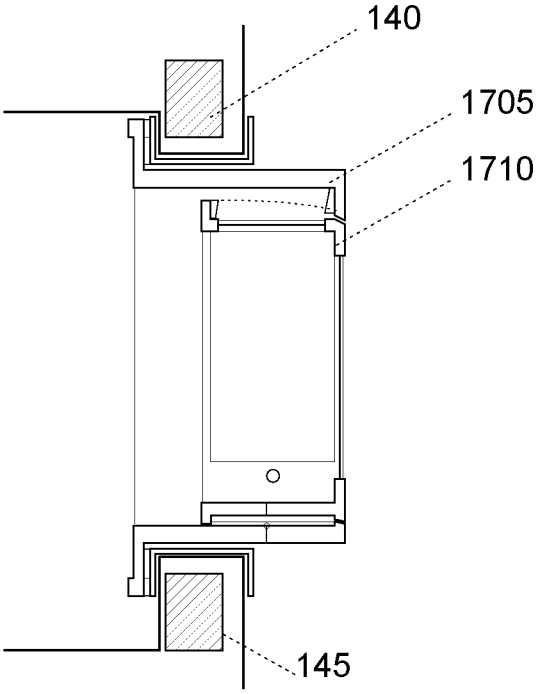
Figure 17E:
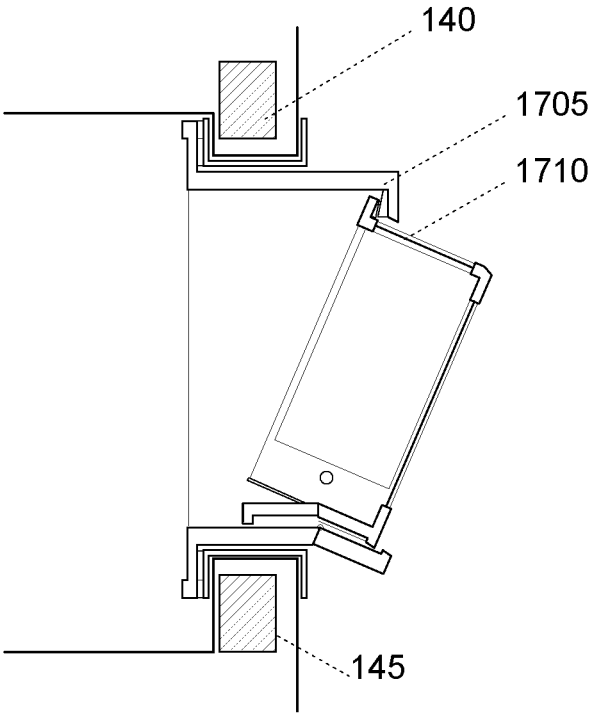
Figure 18A:
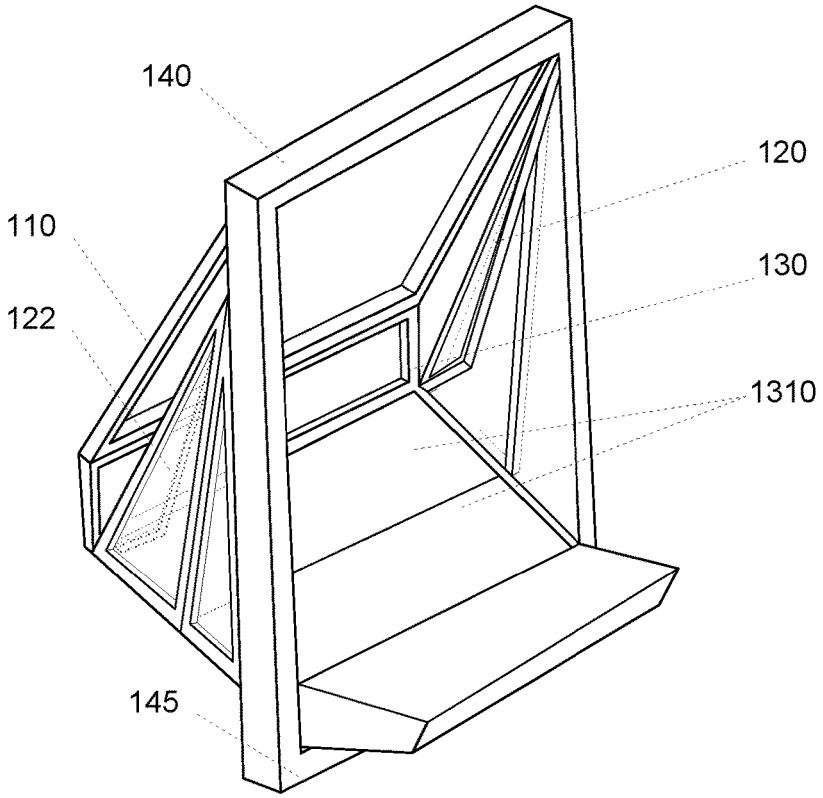
Figure 18B:
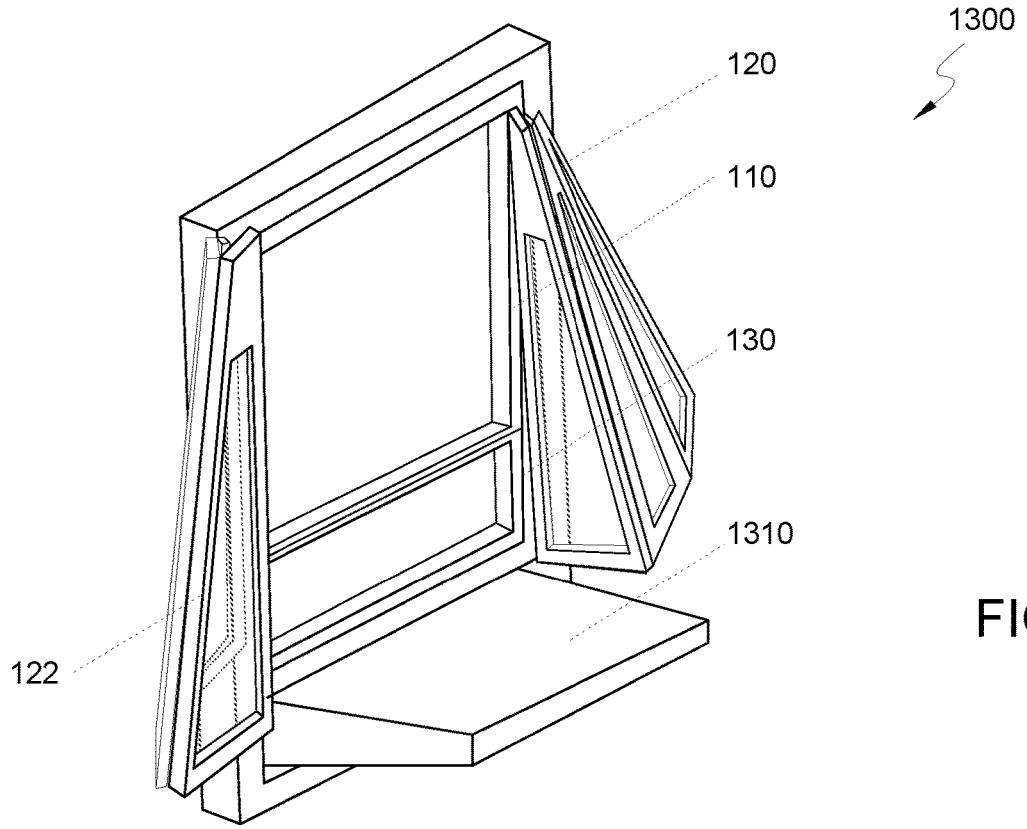
Figure 19:
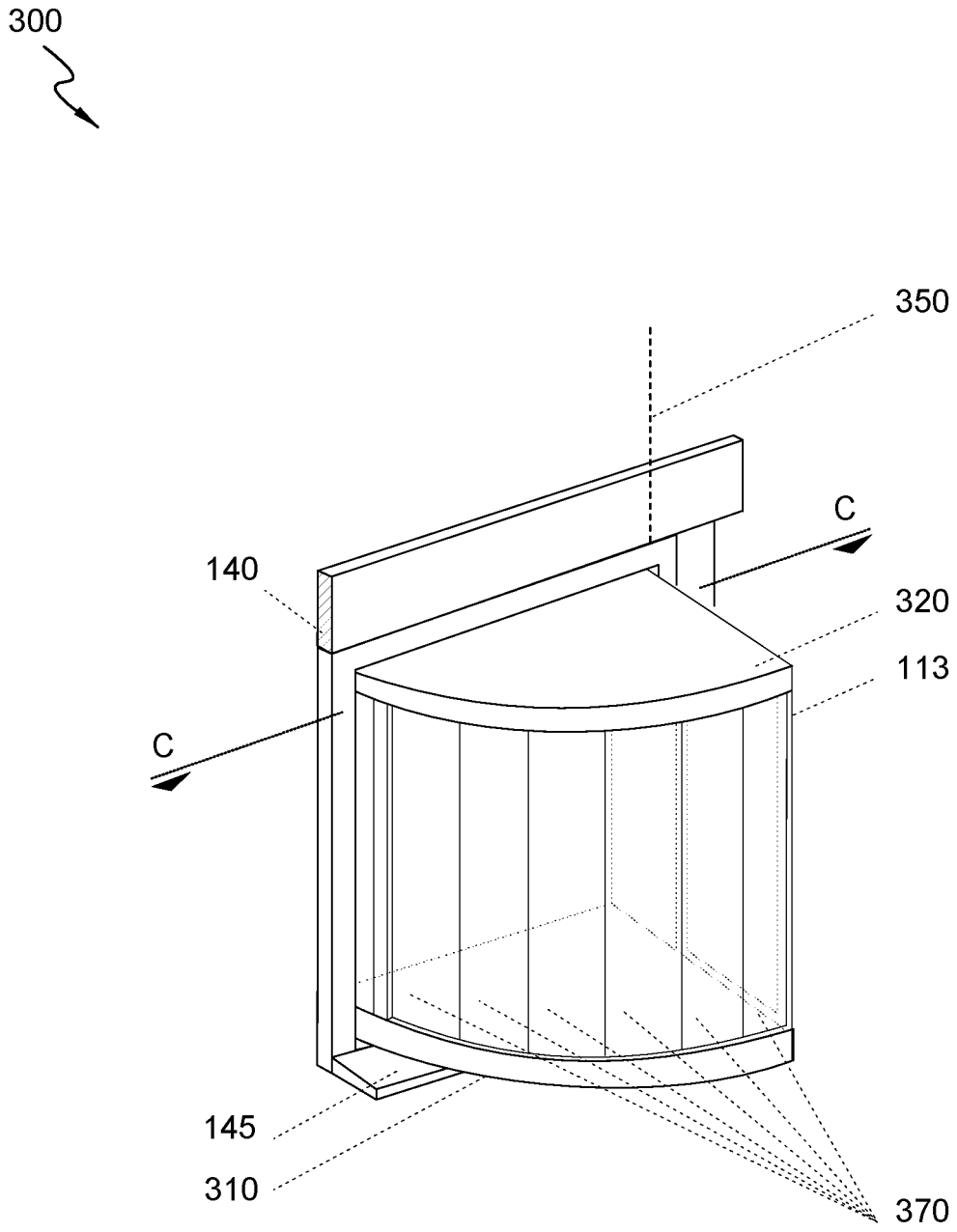
Figure 20A:
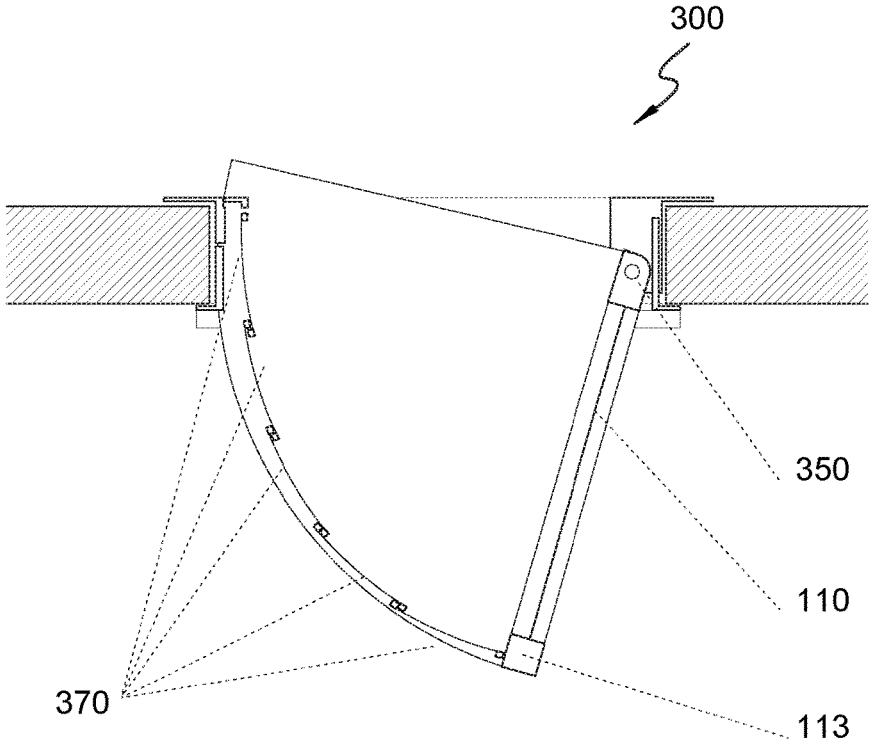
Figure 20B:
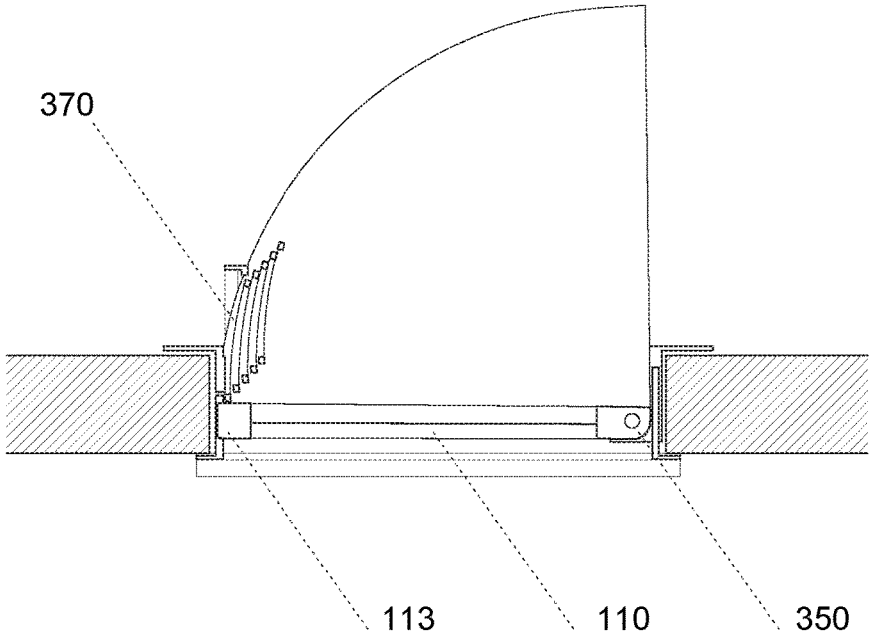
Figure 21:
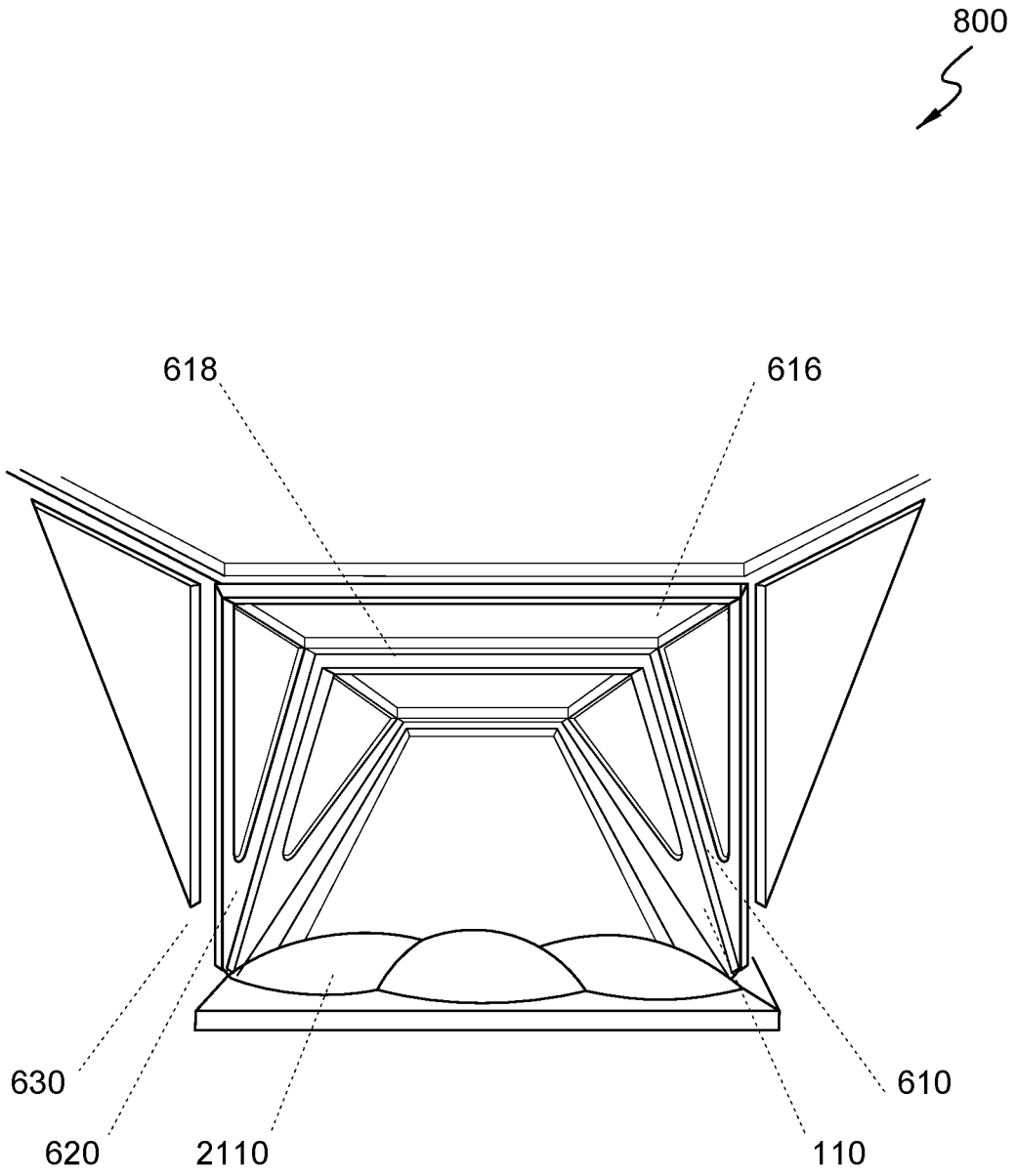
Figure 22:
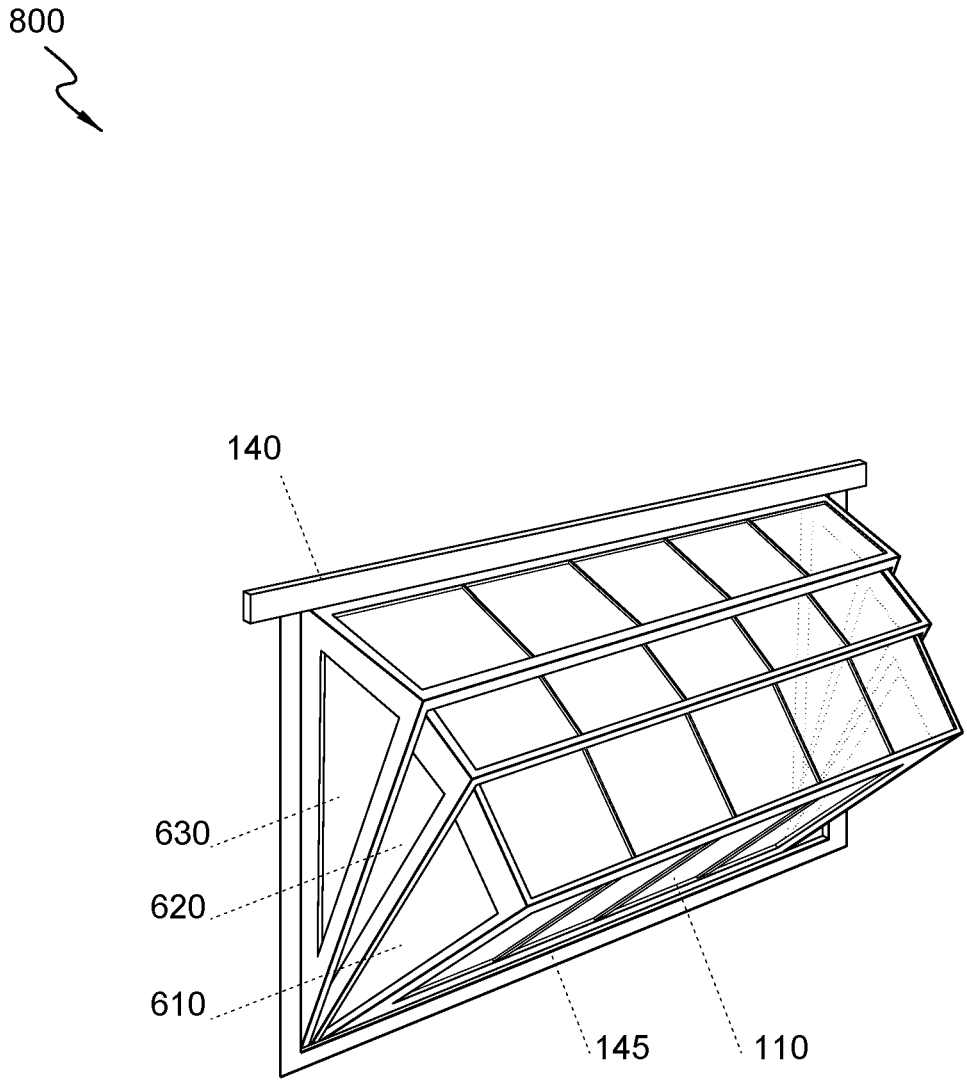
Figure 23A:
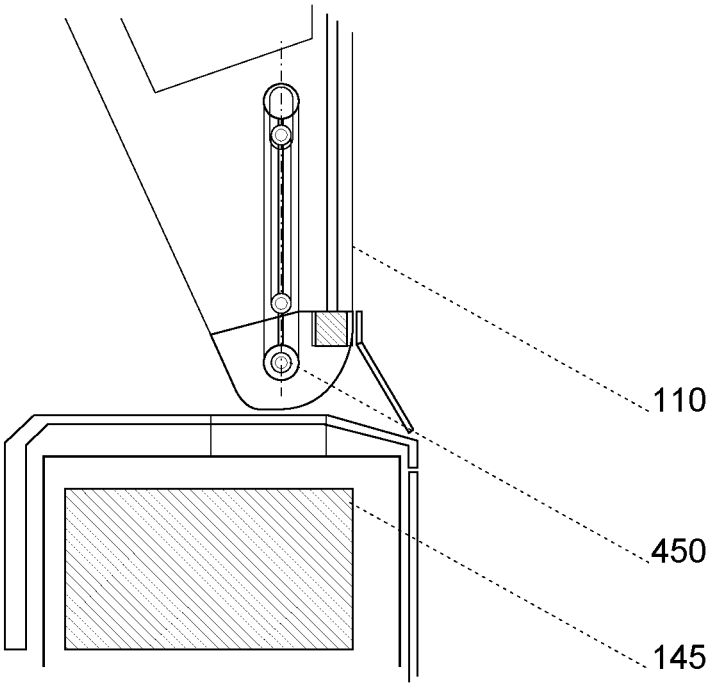
Figure 23B:
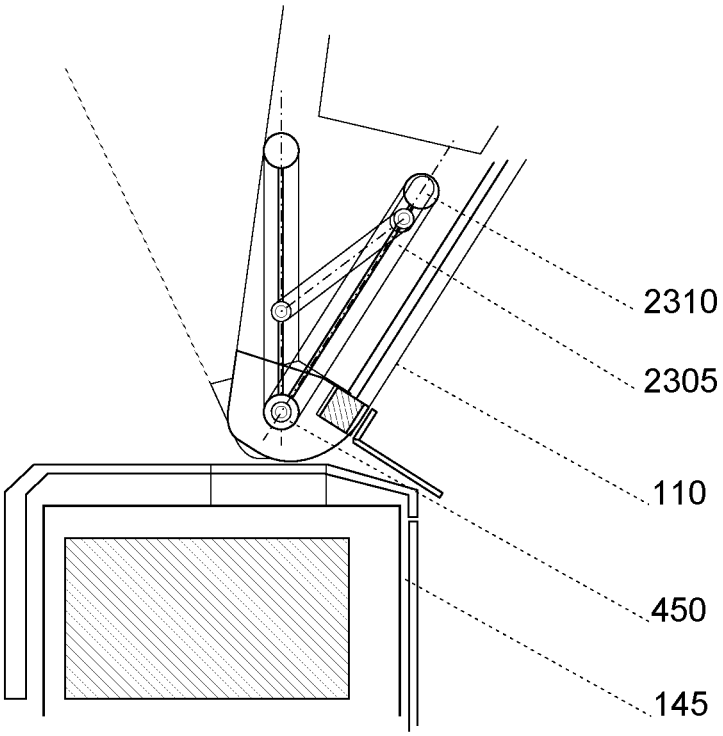
Figure 24:
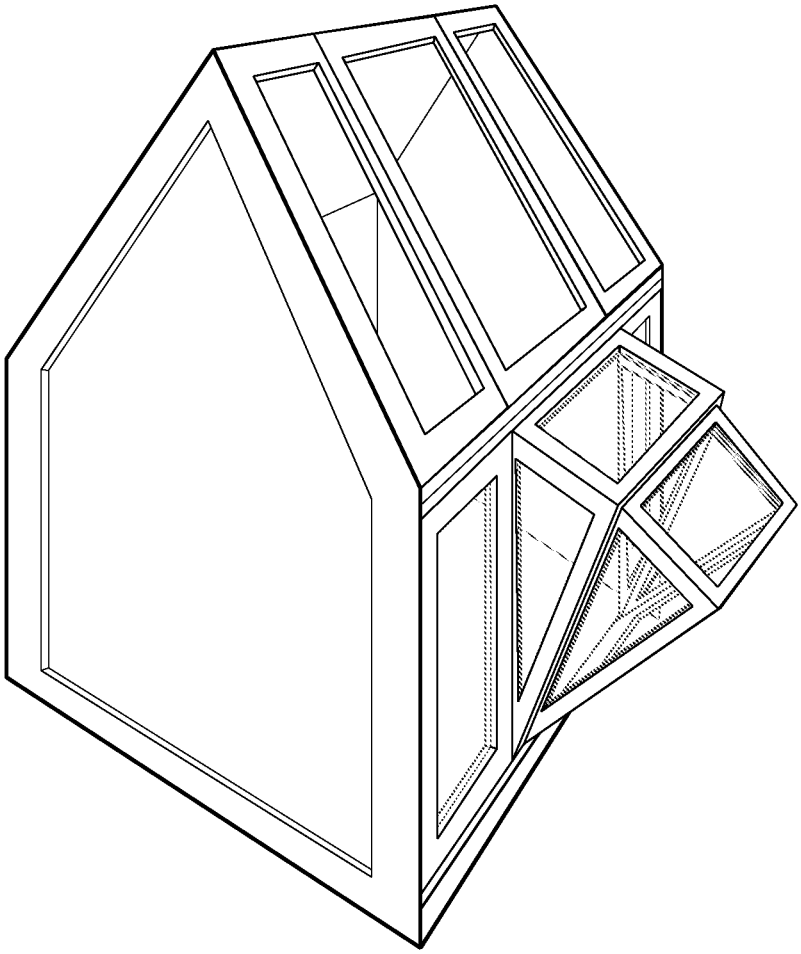
Figure 25A:
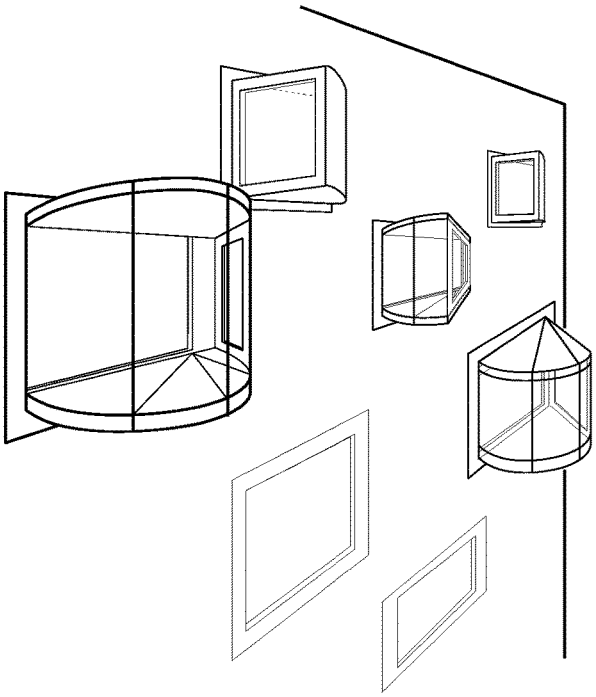
Figure 25B:
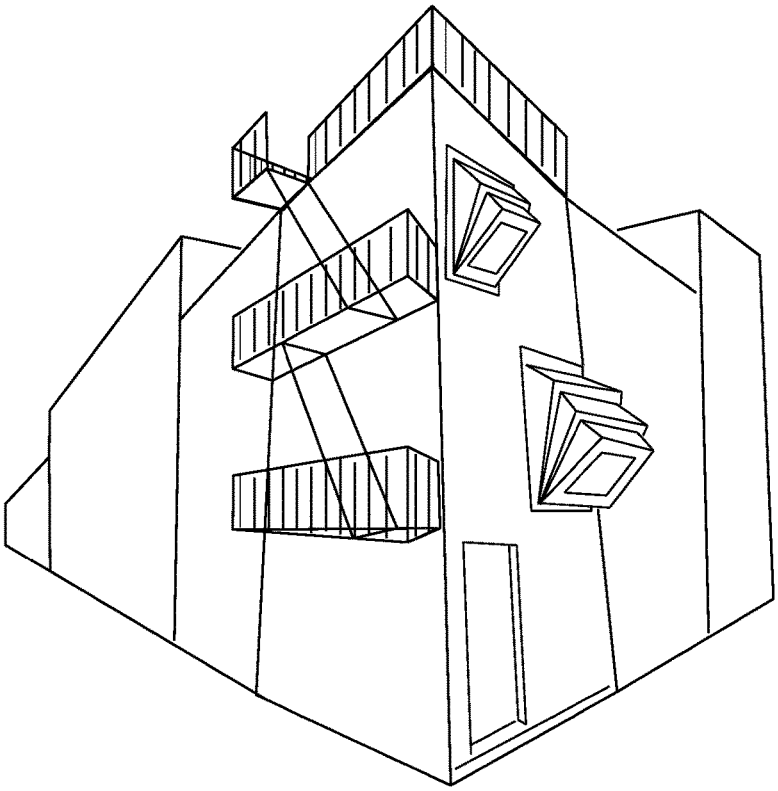
Figure 26:
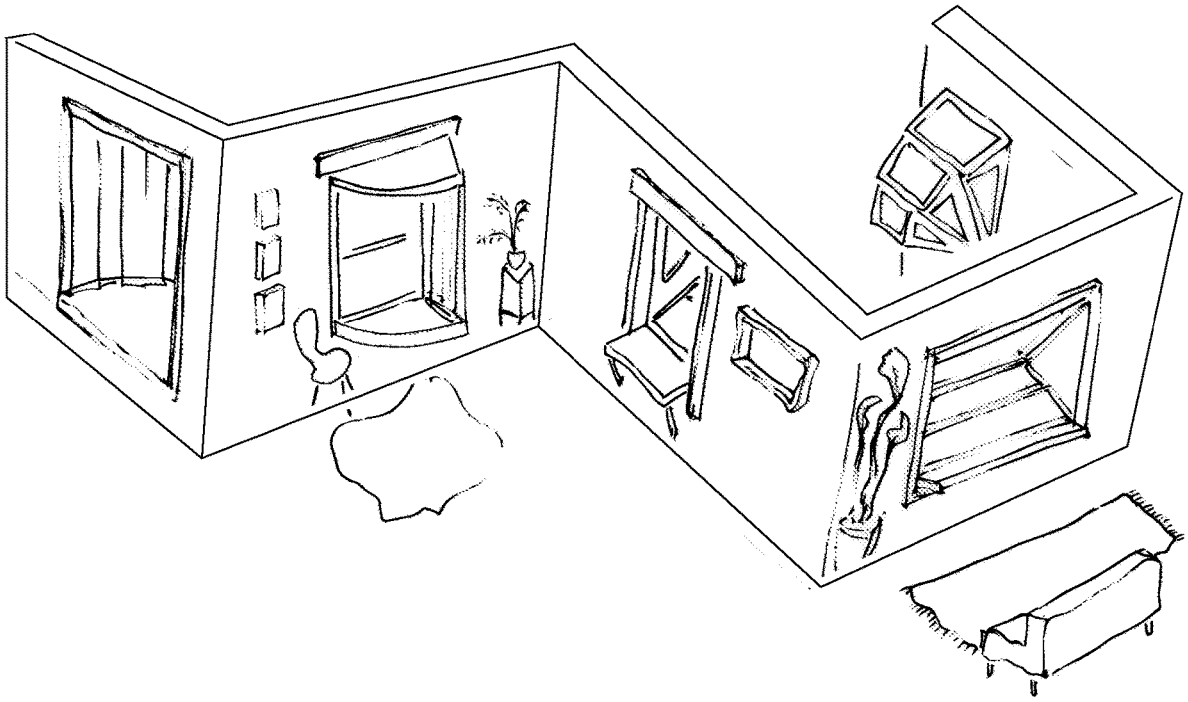

FIGS. 14A-C illustrate various views of a still further open hopper embodiments of the present disclosure;

FIG. 15A illustrates a side view of and a perspective view of an open hopper embodiment of the present disclosure;

FIG. 15B illustrates a perspective view of an open hopper embodiment of FIG. 15A of the present disclosure;

FIG. 16A illustrates a side view of a further embodiment of the present disclosure in an open position;

FIG. 16B illustrates a perspective view of the further embodiment of FIG. 16A of the present disclosure in an open position;

FIG. 16C illustrates a side view of the further embodiment of FIG. 16A of the present disclosure in a closed position;

FIGS. 17A-17B illustrate perspective views of an extending embodiment according to the present disclosure;

FIGS. 17C-17E illustrate side views of an extending embodiment of FIGS. 17A-17B of the present disclosure;

FIGS. 18A-18B illustrate open and closed perspective views of the awning embodiment of FIG. 13 according to the present disclosure;

FIG. 19 illustrates a perspective view of an open casement of FIG. 3 of the present disclosure;

FIG. 20A illustrates a top cut away, along line C-C, view of an open casement of FIG. 3 of the present disclosure;

FIG. 20B illustrates a top cut away, along line C-C, view of a closed casement of FIG. 3 of the present disclosure;

FIG. 21 illustrates an interior view of a hopper embodiment of FIG. 8 of the present disclosure;

FIG. 22 illustrates an exterior view of a hopper embodiment of FIG. 8 of the present disclosure;

FIGS. 23A-23B illustrate an example attachment mechanism of a hopper embodiment of the present disclosure;

FIG. 24 illustrates a small detached building with an open hopper embodiment of the present disclosure;

FIG. 25A illustrates a large building with several different open casement embodiments of the present disclosure;

FIG. 25B illustrates a large building with two open hopper embodiments of the present disclosure; and FIG. 26 illustrates a building interior having several embodiments of the present disclosure.

DETAILED DESCRIPTION

Example embodiments of the present disclosure are described more fully hereinafter with reference to the accompanying drawings, in which some, but not all embodiments of the invention are shown. Indeed, the invention(s) may be embodied in many different forms and should not be construed as limited to the example embodiments set forth herein. Like reference numerals refer to like elements throughout.

In the context of embodiments in an open, or extended position, as used herein, the terms "inward" and "outward" are to be construed to mean a portion of a member or section closest and furthest, respectively, from the exterior line of a building as facade or walls within which any of the hereinafter described embodiments may be mounted. In the context of embodiments in a closed, or retracted position the reference point has changed, and thus, the terms "inward" and "outward" may be construed to mean a portion of a member or section furthest and closest, respectively, from the exterior of a building.

The present disclosure relates to the intersection of the fields of architecture and industrial design where a building structure or addition may be designed focusing on its relationship to the human body, and applied to urban environments. Urban environments, due to their limited land area or space to build, are often overpopulated and overbuilt with structures that have limited access to outdoor/open space. These structures may be limited in square footage and/or may have limited access to outdoor/open spaces or the surroundings. Even luxury apartment dwellings may have limited visibility to the outdoors by lacking in windows or having views directed towards other apartment buildings. The views offered by apartment buildings may be obstructed by other buildings, and may limit the amount of natural light that may be received in the interior of an apartment. Apartment living may create a psychological and/or physical disconnect between the occupant of the apartment and the outdoors.

A solution disclosed and described herein is directed to structures that allow for a temporary or semi-permanent niche as part of newly designing or retrofitting building facades and new constructions to allow occupants to comfortably and safely enjoy more interior protected space by extending the building's window structures beyond the building's facade and secondary facade. As illustrated by FIGS. 24, 25A, and 25B, embodiments of the present disclosure may be incorporated in detached structures as well as in multistory buildings. The disclosure describes a sensorial experience for the user, and provides a context where the user may comfortably and safely enjoy nature, the elements, and the sky from a protected structure that extends beyond the outer walls of a building. The experience is one that brings an occupant from the indoors to the outdoors, and provides an opportunity for a view of the outdoors, the sky and/or an extended view. A window system that provides a temporary or semi-permanent cover when the window is opened outwards to create a comfortable and secure space on the exterior line of a building facade is hereinafter described. See FIG. 26, which illustrates the installation of several embodiments of the present disclosure into the walls of a single continuous space.

One embodiment of the disclosed building structure, the awning embodiment, may consist of a large swinging window and pane that may be hinged near the top of a window frame. In such an embodiment, the sides of the system may be fixed so as to swing together with the large swinging window and pane and may be comprised of a two-part folding frame. The bottom surface of the embodiment may include a two-part folding frame that may be unfolded before opening the window. This embodiment may provide the user with a larger viewing area as compared to existing windows.

Another embodiment of the disclosed building structure, the casement embodiment, may consist of one large rotating window and pane which may be hinged on one side. In such an embodiment, the base may be fixed and a series of fixed glass panels may serve as a vertical enclosure. A top or roof of the embodiment may include a solid or paned, plane surface. This embodiment may provide the user with an area in which to sit in the enclosure on the exterior of the building's facade, and may provide a larger view to the sides of the window system.

A further embodiment of the disclosed building structure, the hopper embodiment, may consist of one large swinging window and pane which may be hinged near the bottom of the window frame. In such an embodiment, the top and sides may include a telescopic cover which extends to open when the large swinging pane is opened. Additionally, this embodiment may include a foldable structural seat which may extend when the hopper embodiment is in an open position. This embodiment may provide the user with a larger view of the area above as compared to existing windows.

A still further embodiment of the disclosed building structure, the extending embodiment, may consist of large telescoping panels which translate perpendicular to a building. These panels or expansion units may translate to create a rectangular enclosure on the exterior of a building.

Awning Embodiment

Figure 1:
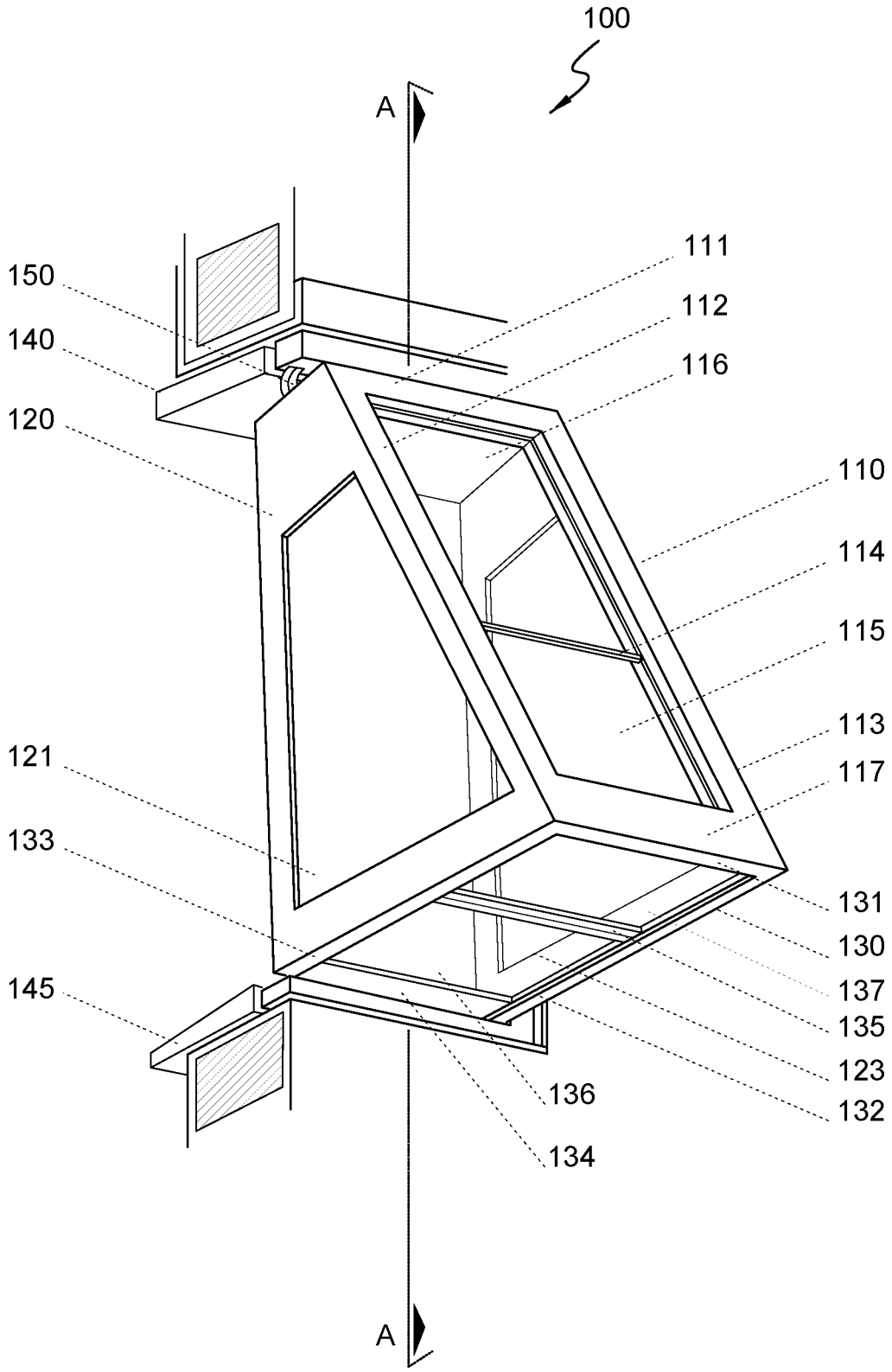
FIG. 1 illustrates a perspective view of an open awning embodiment of the present disclosure.

FIG. 1 illustrates an awning embodiment 100 of the present disclosure. As shown in FIG. 1, the awning embodiment 100 may include an exterior portion 110, side portions 120, a bottom window portion 130, and a mechanism 150. As described in greater detail below, the exterior portion 110 may include a head casing member 111, a bottom casing member 117, a left side casing member 112, a right side casing member 113, and panes 115 and 116 separated by a mullion 114. The side portions may include a left side portion 120, a right side portion 122 (labeled in FIG. 2), a left side pane 121, and a right side pane 123 (labeled in FIG. 2). The bottom window portion 130 may include a front bottom member 131, a bottom left member 133, a bottom right member 132, an interior member 134, a front bottom pane 137, and a rear bottom pane 136 separated by a bottom mullion 135.

With reference to FIG. 1, an awning embodiment 100 of the present disclosure is illustrated mounted in a window frame between the head 140 and the sill 145 of the window frame, and the embodiment is displayed in an open position. In the illustrated embodiment, the exterior portion 110 may be comprised of a casing which includes a head casing member 111, a left casing member 112, a right casing member 113, and a bottom casing member 117. The exterior portion 110 may be formed to resemble a window by the left casing member 112 and the right casing member 113 connected vertically between the head casing member 111 and the bottom casing member 117 to create a rectangular like shape. These members may be secured or locked to one another with any appropriate fasteners (e.g., screws, nails, bolts, staples, adhesives, among others) or interconnected (e.g. bending or folding or welding). The head casing member 111 and bottom casing member 117 may be positioned at the top and the bottom of the window frame, respectively. These members may be formed from any suitable structural window material (e.g., vinyl, wood, vinyl aluminum, composite plastic, fiberglass, among others).

The exterior portion 110 may have panes 115 and 116. These panes may be installed in the space created by the connection of the head casing member 111, the left casing member 112, the right casing member 113, and the bottom casing member 117. These panes may be configured to fill the open space created by the connection of the above described casing members. In some embodiments, pane 115 and pane 116 may have the same dimensions. In some embodiments, pane 115 and pane 116 may have different dimensions. The exterior portion 110 may have a mullion 114 that extends horizontally to connect between the left casing member 112 and the right casing member 113. The mullion 114 may form a separation between pane 115 and pane 116. Although illustrated with two panes of relatively equal dimensions in FIG. 1, the exterior portion 110 may include a single pane that fills the entire space created by the connection of the head casing member 111, the left casing member 112, the right casing member 113, and the bottom casing member 117. Although the illustrated exterior portion 110 in FIG. 1 is shown with two panes 115 and 116, other pane configurations (e.g., single pane, double pane, four-over-four, four-over-one, six-over-six, six-over-one, among others) are contemplated by the embodiments of the present disclosure without limitation. The exterior portion 110 may outwardly resemble a traditional window when closed, and may be substantially flush with the exterior of the building's facade in which the awning embodiment 100 is installed when in a closed position.

Figure 2:
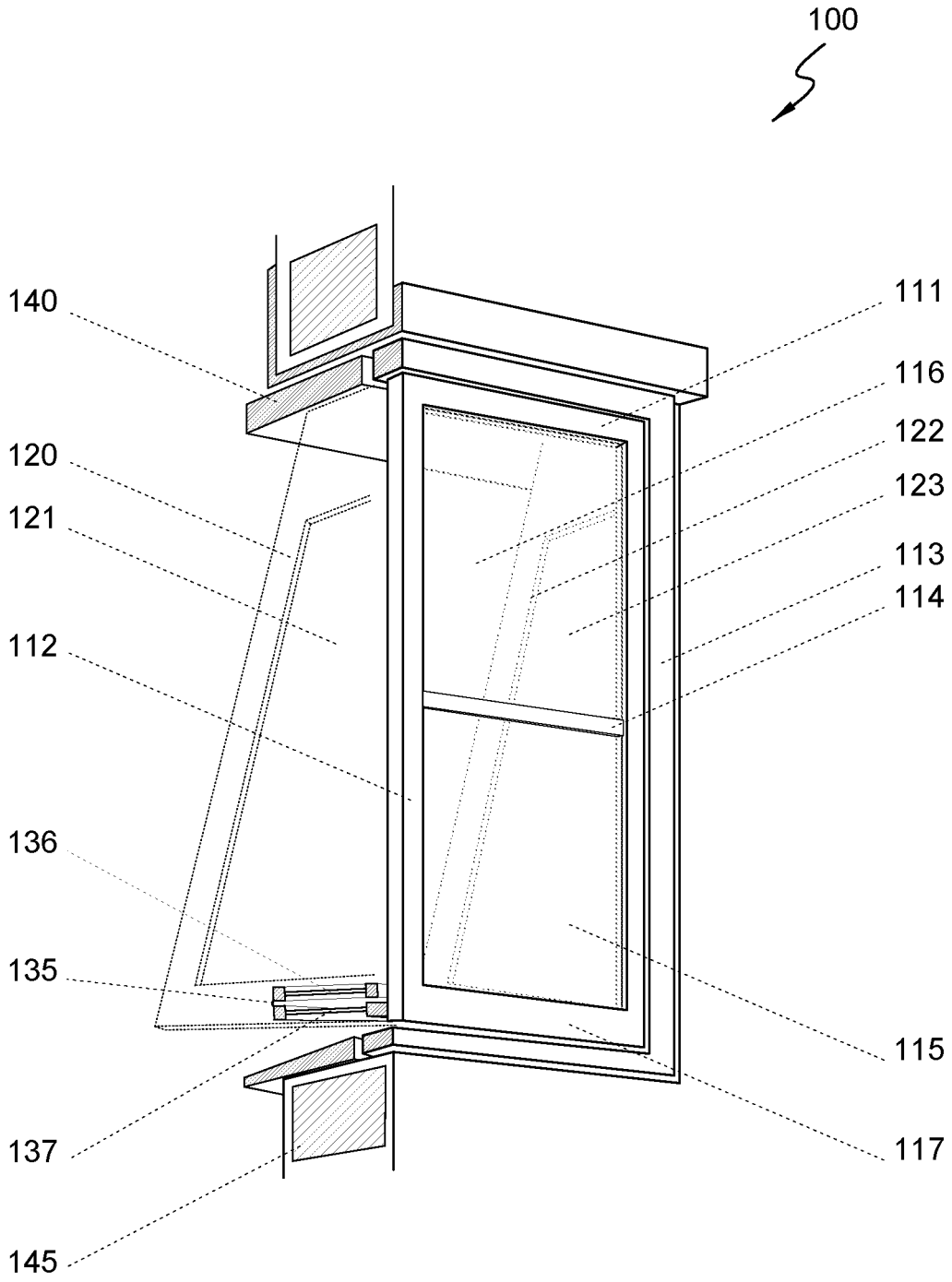
FIG. 2 illustrates a perspective view of a closed awning embodiment of FIG. 1 according to that example embodiment of the present disclosure.

With reference to FIG. 1, the awning embodiment 100 of the present disclosure may also include side portions. These side portions may be comprised of a left side panel 120, a left side pane 121, a right side panel 122, and a right side pane 123. As indicated by FIGS. 1-2, the outward vertical edge of the left side panel 120 and the right side panel 122 may be attached or interconnected to the left casing member 112 and right casing member 113 of the exterior portion 110, respectively. In some embodiments, this attachment may be substantially orthogonal with respect to the exterior portion 110. The inward vertical edge of the left side panel 112 and the right side panel 113 may be substantially flush with the exterior of the building's facade when the awning embodiment 100 is in an open position. In some embodiments, when the awning embodiment 100 is in a closed position, the inward vertical edges of the side panels may extend into the interior of the building. The outward vertical edge of the left side panel 112 and the right side panel 113 may be substantially flush with or level with the exterior of the building's facade when the awning embodiment 100 is in a closed position. The top end of the left side panel 120 and the right side panel 122 may be movably connected by way of a mechanism 150 described hereinafter. The lower edge of the left side panel 120 and the right side panel 122 may attach to or be part of or integrated with a bottom left casing member 133 and a bottom right casing member 132, respectively, on the bottom window member 130 hereinafter described. These members may be secured to one another with any appropriate fasteners (e.g., screws, nails, bolts, staples, adhesives, among others) or interconnected by, for example, welding and may be formed from any suitable material for window construction (e.g., vinyl, wood, vinyl aluminum, composite plastic, fiberglass, among others). In some embodiments, the left side panel 120 and right side panel 122 may be formed from a collapsible or foldable material (e.g., canvas, vinyl, among others).

The side portions may have a left side pane 121, and a right side pane 123 in the left side portion 120 and the right side portion 122, respectively. The left side pane 121 and the right side pane 123 may be configured to occupy an area nearing the size of its respective side portion. Although the illustrated embodiment in FIGS. 1-2 display a single pane configuration for the side portions 122 and 123, other configurations (e.g., double pane, four-over-four, four-over-one, six-over-six, six-over-one, among others) are contemplated by the embodiments of the present disclosure without limitation.

An awning embodiment of the present disclosure may include a bottom window member 130. In the illustrated embodiment, the bottom window member 130 may be comprised of a casing which includes a front bottom casing member 131, a bottom left casing member 133, a bottom right casing member 132, and an interior casing member 134. The bottom window member 130 may be formed to resemble a window by the bottom left casing member 133 and the bottom right casing member 132 connected vertically between the front bottom casing member 131 and the interior casing member 134 to create a rectangular like shape. The front bottom casing member 111 and interior casing member 134 may be positioned at the outward and inward directions of the bottom window member 130, respectively. The front bottom casing member 131 may be attached to the bottom casing member 117 and the bottom left casing member 133 and the bottom right casing member 132 may be attached to the left side portion 120 and the right side portion 122, respectively. The attachment between these described members may be such that an enclosure is created. These members may be secured to one another with any appropriate fasteners (e.g., screws, nails, bolts, staples, adhesives, among others) or interconnected by, for example, welding. These casing members may be formed from any suitable structural window material (e.g., vinyl, wood, vinyl aluminum, composite plastic, fiberglass, among others). In some embodiments, the bottom window member may be formed from a collapsible or foldable material (e.g., canvas, vinyl, among others). The edge of the front bottom member 131 can be substantially flush with the exterior of the building's facade when the awning embodiment is in a closed position. The bottom window member 130 may extend into the interior of the building when the embodiment is in a closed or retracted position.

The bottom window member 130 may have a pane 137 and a pane 136. These panes may be configured to fill the open space created by the connection of the above bottom window casing members. In some embodiments, the pane 137 and the pane 136 may have the same dimensions and shape. In other embodiments, pane 137 and pane 136 may have different dimensions and shapes. The bottom window member 130 may have a bottom mullion 135 that extends horizontally to connect between the bottom left casing member 133 and the bottom right casing member 132. The bottom mullion 135 may form a separation between the pane 137 and the pane 136. Although illustrated with two panes of relatively equal dimensions and of similar shape in FIG. 1, the bottom window member 130 may, for example, include a single pane that fills the entire space created by the connection of a front bottom casing member 131, a bottom left casing member 133, a bottom right casing member 132, and an interior casing member 134. Although the illustrated bottom window member 130 in FIG. 1 is shown with two panes, other pane configurations and shapes (e.g., single pane, double pane, four-over-four, four-over-one, six-over-six, six-over-one, among others) are contemplated by the embodiments of the present disclosure without limitation.

An awning embodiment 100 of the present disclosure may include a mechanism 150. The mechanism 150 may be attached atop the left side panel 120 and the right side panel 122 and may be attached along its length to the head casing member 111 of the exterior portion 110. In some embodiments, this mechanism 150 may be a pivot rod to allow for the opening of the awning embodiment 100. The top of the awning embodiment 100, through the left side panel 120, the right side panel 122 and the head casing member 111, may be pivotally connected to a pivot rod mounted near the top of the window frame perpendicular to the opening motion of the awning embodiment 100. Although the illustrated example utilizes a pivot rod at the top of the window frame as the mechanism 150, other mechanisms allowing motion about a fixed end (e.g., hinges, socket joints, among others) are contemplated by the embodiments of the present disclosure without limitation. Additionally, the illustrated awning embodiment 100 in FIG. 1 can include means by which the embodiment is propelled open or extended outward. However, such mechanisms for opening the embodiment (e.g., sliders, rollers, spring loaded side arms, crank arms, motor powered arms, pneumatic arms, among others) are contemplated by embodiments of the present invention and disclosure without limitation.

With respect to FIG. 2, the awning embodiment 100 of the present disclosure is illustrated in a closed or retracted position. As above, the awing embodiment 100 may be mounted in a window frame between the head 140 and the sill 145. In the closed position, the exterior portion 110 may be substantially flush with the exterior of the structure in which it is mounted. From the exterior of the structure, the exterior portion 110 including the head casing member 111, the left casing member 112, the right casing members 113, and the bottom casing member 117 may be visible. As shown in FIG. 2, pane 136 is depicted rotated about the bottom mullion 135 and rests on pane 137. In an alternative embodiment (not shown) the present disclosure contemplates a variety of means for storage of the bottom window member 130, specifically pane 136 and pane 137, in order to reduce intrusion into the interior of the building when the awning embodiment 100 is in a closed or retracted position. The present disclosure contemplates that the bottom window member 130 may be rotated about the bottom casing member 117 and stored against the pane 115 on either the interior or exterior of the window frame. In a further alternative embodiment (not shown), the present disclosure contemplates that the bottom window member 130 may be detachable from the awning embodiment 100 and storable until needed for use in the open position shown in FIG. 1. The dimensions and/or shapes of these panes may be such that the width of front panel 137 is equal to, or less than, the width of the sill 145 so that the rear pane 136 may be rotated about the bottom mullion 135 to not project into the room when the embodiment is in a retracted position.

Panes may be present on each of the surfaces exposed to the exterior of the building including the left side panel 120, the right side panel 122, the bottom window member 130, and the exterior portion 110. The present disclosure contemplates that each of these panes may be individually fixed in a closed position. In contrast, the present disclosure also contemplates that in some embodiments, each of these panes may be individually openable through a variety of means. In such an embodiment, the panes may be openable by rotating about an attachment axis (for example, attachment axis 640 in FIG. 6). The panes may also be openable by a sliding mechanism in which the panes translate horizontally at least a distance into their respective casings to provide at least a portion of open space in their respective surfaces. The panes may also be available as inserts in which the panes are removable to provide either open or closed portions of their respective surfaces.

According to the illustrated awning embodiment 100, the embodiment may initially be in a closed or retracted position as shown in FIG. 2. In such a position, the exterior portion 110 may be substantially flush with the exterior of the building while the side portions and the bottom window member 130 may extend into the interior of the building. In some embodiments (not shown), the side portions, the left side panel 120 and the right side panel 122, may be made of a collapsible or compressible material to reduce intrusion into the building's interior. In some embodiments, the side portions may be detachable from the exterior portion 110, bottom window member 130, and mechanism 150 to be stored while the awning embodiment 100 rests in a closed or retracted position. Similarly, in some embodiments, the bottom window member 130 may be made of a collapsible or compressible material to reduce intrusion into the building's interior or may be detachable from the exterior portion 110 and side portions to be stored while the awning embodiment 100 rests in a closed or retracted position.

As will be appreciated from the description herein, the mechanism's 150 attachment along the length of head casing member 111 permits the exterior portion 110 to pivot about the top end of the window frame to extend into an open position as shown in FIG. 1. The path of motion of the embodiment may follow a generally parabolic motion perpendicular to that of the exterior of the building in which the awning embodiment 100 is installed. As the embodiment is extended into an open position, the side panels may extend outward to form sides of an enclosure. In a similar manner, the bottom window member 130 may extend outward as the awning embodiment extends outward to form the bottom of an enclosure. In some embodiments, the mechanism 150 may be a pivot rod to allow motion about a fixed end. As discussed above, the figures do not indicate the means by which the embodiment is propelled open or extended outward. However, mechanisms for opening the awning embodiment 100 (e.g., sliders, rollers, spring loaded side arms, crank arms, motor powered arms, pneumatic arms, among others) are contemplated by embodiments of the present disclosure without limitation. Although depicted in a closed and fully extended position in FIGS. 1-2, the present disclosure contemplates the awning embodiment 100 extending to any point along the path from a closed position to fully extended position.

Figure 11:
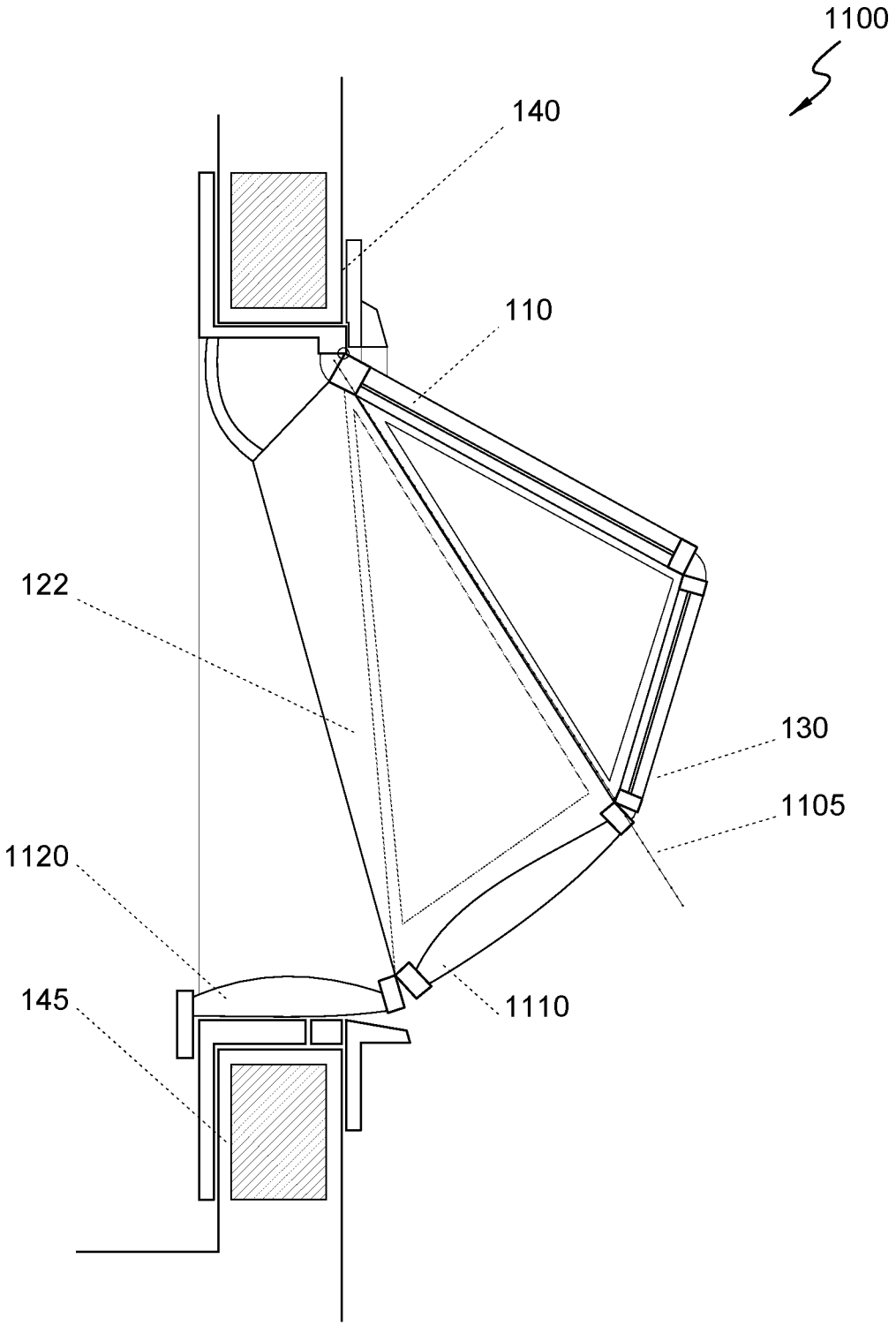
FIG. 11 illustrates a side view of an alternative open awning embodiment of the present disclosure.

With reference to FIG. 11, a cut-away view of an alternative awning embodiment 1100 of the present disclosure is illustrated mounted in a window frame between the head 140 and the sill 145 and displayed in an open position. In some embodiments, the right side panel 122 can be opened by inward rotation about an axis 1105 such that open space is present on the right side panel 122. The awning embodiment 1100 is depicted with an exterior portion 110 and a bottom window member 130 which may be formed to resemble windows. An awning embodiment 1100 may have an upper seat member 1110 and a lower seat member 1120. In some embodiments, the side panels may be comprised of multiple panels housing each housing panes. By way of example, and with continued reference to FIG. 11, the awning embodiment 1100 may have a right side panel 122. In some embodiments, the upper seat member may extend beyond the exterior of the building in which the embodiment is installed when the awning embodiment 1100 is in an open or extended position. The lower seat member 1120 may rest upon the sill 145 when the awning embodiment 1100 is in an open position. When the awning embodiment 1100 is in a closed or retracted position, the upper seat member 1110 and the lower seat member 1120 may extend into the interior of the building. The present disclosure contemplates a variety of means for storage of the upper seat member 1110 and lower seat member 1120 in order to reduce intrusion into the interior of the building when the awning embodiment 1100 is in a closed or retracted position. The present disclosure contemplates that these seat members may be rotated and stored against the portion 110 of the interior of the window frame. Additionally, the present disclosure contemplates that the seat members may be detachable from the awning embodiment 1100 and storable until needed for use in the open position shown in FIG. 11.

Figure 12:
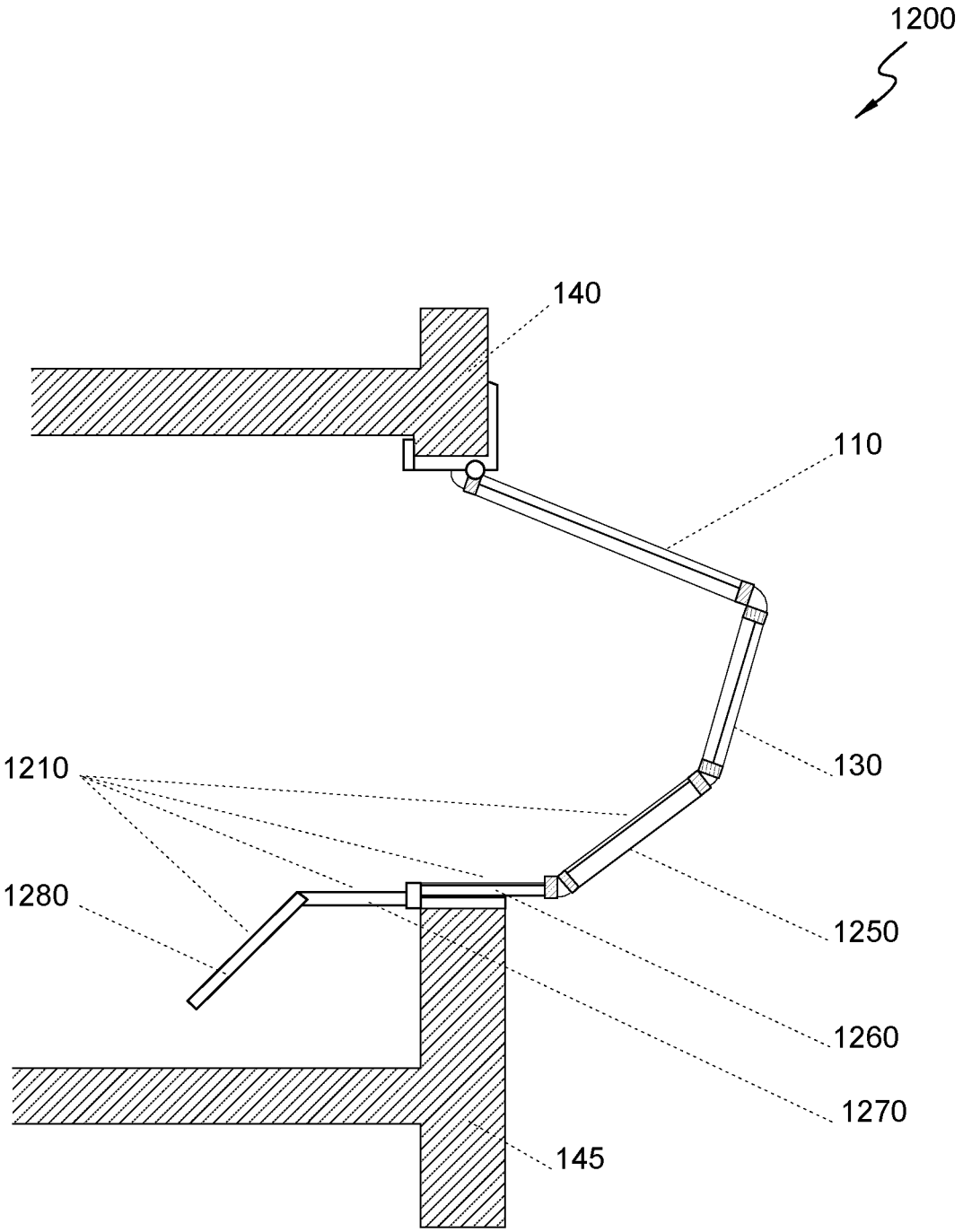
FIG. 12 illustrates a side view of an alternative open awning embodiment of the present disclosure.

With reference to FIG. 12, a further awning embodiment 1200 of the present disclosure is illustrated mounted in a window frame between the head 140 and the sill 145 and displayed in an open position. The awning embodiment 1200 is depicted with an exterior portion 110 and a bottom window member 130 which may be formed to resemble windows. The awning embodiment 1200 may have a reclined seat portion 1210. This reclined seat portion 1210 may be comprised of a back member 1250, a base member 1260, an upper leg member 1270, and a lower leg member 1280. Collectively, these members may be pivotally connected and may create a single reclined seat portion 1210. In some embodiments, a portion of the reclined seat portion 1210 (e.g., the back member 1250, base member 1260, and upper leg member 1270) may extend beyond the exterior of the building in which the embodiment is installed when the awning embodiment 1200 is in an open or extended position. The reclined seat portion 1210 may provide a backrest (e.g., angled portion of back member 1250) for a user which extends exterior of the building and a leg support which extends into the interior of the building when the awning embodiment 1210 is in an open or extended position as discussed above. When the awning embodiment 1200 is in a closed position or retracted position, the reclined seat portion 1210 may extend into the interior of the building. The present disclosure contemplates a variety of means for storage of the reclined seat portion 1210 in order to reduce intrusion into the interior of the building when the awning embodiment 1200 is in a closed or retracted position. The present disclosure contemplates that this recline seat portion 1210 may be foldable such that it may be stored against the exterior portion 110 on the interior of the building while the awning embodiment 1200 is in a closed position. For example, each of the lower leg member 1280, the upper leg member 1270, and the base member 1260 may each be pivotally connected to one another such that they may be foldable into a more compact orientation when the embodiment is closed. Additionally, the present disclosure contemplates that the reclined seat portion 1210 may be detachable from the awning embodiment 1200 (either in whole or by removing each member independently) and storable until needed for use in the open position shown in FIG. 12.

With reference to FIG. 13, an awning embodiment 1300 of the present disclosure is illustrated mounted in a window frame between the head 140 and the sill 145 and displayed in an open position. The perspective view of the awning embodiment 1300 is depicted with an exterior portion 110 and a bottom window member 130 which may be formed to resemble windows. An awning embodiment 1300 may have the exterior portion 110 may include a head casing member 111, casing member 117, a left casing member 112, a right casing member 113, and a pane 115. The awning embodiment 1300 may include a bottom window member 130 comprised of a front bottom casing member 131, a bottom left casing member 133, a bottom right casing member 132, an interior casing member 134. The awning embodiment 1300 may also have side portions including a left side panel 120 and a right side panel not shown. The left side panel 120, in FIG. 13, is shown in a closed position created by rotation about an axis 1305 such that open space is present on the left side panel 120.

When the awning embodiment 1300 is in an open or extended position, the exterior portion 110, the bottom window member 130, the seat member 1310, and the side portions may be connected to create an enclosure. In some embodiments, the exterior portion 110 and the bottom window member 130 may be substantially flush with the building's facade when the awning embodiment 1300 is in a closed or retracted position. When the awning embodiment 1300 is in a closed position or retracted position, the seat member 1310 and side panels may extend into the interior of the building. The present disclosure contemplates a variety of means for storage of the seat member 1310 and side panels in order to reduce intrusion into the interior of the building when the awning embodiment 1300 is in a closed or retracted position. The present disclosure contemplates that the seat member 1310 and side panels may be detachable from the awning embodiment 1300 and storable until needed for use in an open position.

FIGS. 18A-18B illustrate an interior view of awning embodiment 1300 in an open and closed position, respectively. When awning embodiment 1300 is in a closed or retracted position, the exterior window member 110 and the bottom window member 130 may be flush with the exterior of the building and resemble conventional window systems. Additionally, the seat member 1310 may fold such to provide the use with an additional shortened seat on the interior of the building. When the awning embodiment 1300 is in an open or extended position, the seat member 1310 may extend exterior of the building to form the bottom portion of an enclosure while the bottom window member 130 is substantially parallel with the exterior of the building. In some embodiments, as discussed above, the side panels may be comprised of multiple panels. As depicted in FIGS. 18A-18B, right side panel 122 and left side panel 120 comprise multiple inserts each capable of inward rotation such that an open space is present in each respective surface.

With reference to FIGS. 16A-16B, an alternative awning embodiment 1600 is displayed mounted in a window frame between the head 140 and the sill 145 in an open or extended position. Similar to the awning embodiment shown in FIG. 1, awning embodiment 1600 may have an exterior portion 110, bottom window member 130, and side panels (e.g., left side panel 120 in FIG. 1). Awning embodiment 1600 may be attached along the length of the top of the exterior portion 110 to a mechanism 150. This attachment may permit the exterior portion 110 to pivot about the top end of the window frame to extend into an open position as shown in FIG. 16B. The path of motion of the embodiment may follow a generally parabolic motion perpendicular to that of the exterior of the building in which the awning embodiment is installed. As the embodiment is extended into an open position, the side panels may extend outward to form sides of an enclosure. In a similar manner, the bottom window member 130 may extend outward as the awning embodiment extends outward to form the bottom of an enclosure. In FIG. 16A, bottom window member 130 projects at an acute angle from the exterior facade below sill 145. However, when awning embodiment 1600 is closed, as shown in FIG. 16C, the bottom window member 130 may extend downward along the exterior facade below the sill 145. In such an embodiment, when open, or extended, the attachment between the exterior portion 110 and the bottom window member 130 can form an obtuse angle. Additionally, in a preferred version of this embodiment, bottom edge 1620 of the bottom window member 130 moves vertically when awning embodiment 1600 opens or closes. Similarly, the alternative awning embodiment 1600 may be retraced such that the exterior portion 110 is substantially flush with the building's exterior. In such an embodiment, the bottom window member 130 may move upwardly about the connection between its connection to the exterior portion 110 and allow for the exterior portion to retract flush with the building's exterior.

In some embodiments, the awning embodiment 1600 may further define a window track 1610. In such an embodiment, the bottom edge 1620 of the bottom window member 130 may engage window track 1610. Window track 1610 is mounted to or is adjacent to the exterior of the facade below sill 145. Thus, bottom edge 1620 of the bottom window member 130 translates along the facade of the structure in which the embodiment is installed. The present disclosure contemplates that the awning embodiment 1600 may utilize rollers, bearings, and the like to facilitate the translation of the bottom window member 130 in the window track 1610.

Casement Embodiment

FIG. 3 illustrates a casement embodiment 300 of the present disclosure. As shown in FIG. 3, the casement embodiment may include an exterior portion 110, vertical sections 370, a top member or roof 320, and a bottom member or platform 310. As described in greater detail below, the exterior portion 110 may include a head casing member 111, a casing member 117, a right casing member 112, a left casing member 113, and panes 115 and 116 separated by a mullion 114.

With reference to FIG. 3, a casement embodiment 300 of the present disclosure is illustrated mounted in a window frame between the head 140 and the sill 145 of the window frame, and displayed in a closed or retracted position. In the illustrated embodiment, the exterior portion 110 may be comprised of a casing which includes a head casing member 111, a left casing member 113, a right casing member 112, and a casing member 117. The exterior portion 110 may be formed to resemble a window by the left casing member 113 and the right casing member 112 connected vertically between the head casing member 111 and the casing member 117 to create a rectangular shape. These members may be secured to one another with any appropriate fasteners (e.g., screws, nails, bolts, staples, adhesives, among others). The head casing member 111 and casing member 117 may be positioned at the top and the bottom of the window frame, respectively. These casing members may be formed from any suitable structural window material (e.g., vinyl, wood, vinyl aluminum, composite plastic, fiberglass, among others). The exterior portion 110 may have one of the left casing member 113 or the right casing member 112 attached to a mechanism 350 such that the member attached to the mechanism 350 does not extend outward exterior of the building when the embodiment is in an open position. In some casement embodiments, the several members of casement embodiment 300 rotate in unison about pivot mechanism 350. In alternative embodiments, only those members of the casement embodiment that have been engaged, rotate. FIG. 3 illustrates a casement embodiment 300 in which the right casing member 112 is attached to the mechanism 350 such that the left casing member 113 is free to rotate outwardly and extend exterior of the building, while the right casing member 113 is in an arc.

The exterior portion 110 may have panes 115 and 116. These panes may be installed in the space created by the connection of the head casing member 111, the left casing member 113, the right casing member 112, and the casing member 117. These panes may be configured to fill the open space created by the connection of the above listed casing members. In some embodiments, pane 115 and pane 116 may have the same dimensions. In some embodiments, pane 115 and pane 116 may have different dimensions. The exterior portion 110 may have a mullion 114 that extends horizontally to connect between the left casing member 113 and the right casing member 112. The mullion 114 may form a separation between pane 115 and pane 116. Although illustrated with two panes of relatively equal dimensions in FIG. 3, the exterior portion 110 may include a single pane that fills the entire space created by the connection of the head casing member 111, left casing member 113, right casing member 112, and casing member 117. Although the illustrated exterior portion 110 example in FIG. 3 is shown with two panes 115 and 116, other pane configurations (e.g., single pane, double pane, four-over-four, four-over-one, six-over-six, six-over-one, among others) are contemplated by the embodiments of the present disclosure without limitation. The exterior portion 110 may resemble a window and may be substantially flush with the exterior of the building's facade in which the casement embodiment 300 is installed when in a closed position.

With reference to FIG. 3, a casement embodiment 300 of the present disclosure may also include vertical supports or sections 370. These vertical supports or sections 370 may each be attached by their top and bottom edges to the roof 320 and platform 310, respectively. One of the leftmost or rightmost vertical edges of the vertical supports or sections 370 may be attached to the casing member of the exterior portion 110 that is free to rotate outwardly and extend exterior of the building, left casing member 113 or right casing member 112. In some embodiments this attachment between the vertical edge of the vertical section 370 and the exterior portion 110 may be substantially orthogonal. The vertical end edge not attached to the casing member may be substantially flush with the exterior of the building's facade when the casement embodiment is in an open position. In some embodiments, vertical sections 370 may be individual members attached to one another to form a single member. In other embodiments, the vertical section 370 may be a single largely-cylindrical member attached vertically between the roof 320 and platform 310. The vertical sections 370 may be attached with any appropriate fasteners (e.g., screws, nails, bolts, staples, adhesives, among others) and may be formed from any suitable material for window construction (e.g., vinyl, wood, vinyl aluminum, composite plastic, fiberglass, among others). In some embodiments, the vertical sections 370 may be formed from a collapsible or foldable material (e.g., canvas, vinyl, among others). Although only three vertical sections 370 are shown in FIG. 3, the present disclosure contemplates any number of vertical, or horizontal, sections without limitation.

The vertical supports or sections 370 of the casement embodiment 300 may have solid or flexible panes. The panes may be configured to occupy an area up to the size of the respective vertical section. Although the illustrated embodiment in FIG. 3 displays a single member for each vertical supports or section 370, other paned configurations (e.g., double pane, four-over-four, four-over-one, six-over-six, six-over-one, among others) are contemplated by the embodiments of the present disclosure without limitation.

A casement embodiment 300 of the present disclosure may include a roof 320. The roof 320 may be attached to the top edges of the vertical sections or supports 370 and to the head casing member 111 of the exterior portion 110. In some embodiments the attachment between the roof 320 and head casing member 111 may be such that the roof 320 is configured to be substantially orthogonal to the exterior portion 110. The attachment between these members and a platform 310 described hereinafter may be such that an enclosure is created. These members may be secured to one another with any appropriate fasteners (e.g., screws, nails, bolts, staples, adhesives, among others). These members may be formed from any suitable structural window material (e.g., vinyl, wood, vinyl aluminum, composite plastic, fiberglass, among others). In some embodiments, the roof 320 may be formed from a collapsible or foldable material (e.g., canvas, vinyl, among others). The present disclosure contemplates that the roof 320 may also be a removable insert such that when the casement embodiment is in an open or extended position, the casement embodiment 300 may be open vertically.

In some casement embodiments the roof 320 may have panes. These panes may be configured to occupy a portion of the roof 320 up to and including the maximum dimensions of the roof 320. In some embodiments, the roof 320 may include a single pane that fills the entire space of the roof 320. The present disclosure contemplates a variety of pane configurations (e.g., single pane, double pane, four-over-four, four-over-one, six-over-six, six-over-one, among others).

A casement embodiment 300 of the present disclosure may include a platform 310. The platform 310 may be attached to the bottom edges of the vertical sections 370 and to the bottom casing member 117 of the exterior portion 110. In some embodiments the attachment between the platform 310 and bottom casing member 117 may be such that the platform 310 is configured to be substantially orthogonal to the exterior portion 110 and substantially parallel to the roof 320. The attachment between these above portions of the casement embodiment 300 may be such that an enclosure is created. These members may be secured to one another with any appropriate fasteners (e.g., screws, nails, bolts, staples, adhesives, among others). These members may be formed from any suitable structural window material (e.g., vinyl, wood, vinyl aluminum, composite plastic, fiberglass, among others). In some embodiments, the platform 310 and sections 370 may be formed from a collapsible or foldable material (e.g., canvas, vinyl, among others). The present disclosure contemplates that the platform 310 may also be a removable insert in conjunction with sections 370 folding such that when the casement embodiment is in a closed or retracted position, the casement embodiment 300 may take up less of the interior of the building.

In some casement embodiments the platform 310 may have solid or folding panes. These panes may be configured to occupy a portion of the platform 310 up to and including the maximum dimensions of the platform 310. In some embodiments, the platform 310 may include a single pane that fills the entire space of the platform 310. The present disclosure contemplates a variety of pane configurations for the platform 310 (e.g., single pane, double pane, four-over-four, four-over-one, six-over-six, six-over-one, among others). Although the illustrated platform 310 shown in FIG. 3 displays a single solid member, other configurations (e.g., a collapsible member, a slatted member, a paned member, among others) are contemplated by the embodiments of the present disclosure without limitation. Similarly platform 310 may be connected to the exterior portion 110 and to the vertical sections 370.

A casement embodiment of the present disclosure may include a mechanism 350. The mechanism 350 may be attached at aligning endpoints of the head 140 and sill 145 of the window frame and connected lengthwise along one of the left casing member 113 or the right casing member 112. In some embodiments, this mechanism 350 may be a pivot rod to allow for movement and/or opening of the casement embodiment 100. The left or right end of the casement embodiment 300 may be pivotally connected to a pivot rod mounted near the side of the window frame perpendicular to the opening motion of the casement embodiment 300. Although the illustrated example utilizes a pivot rod one side of the window frame as the mechanism 350, other mechanisms allowing motion about a fixed end (e.g., hinges, socket joints, among others) are contemplated by the embodiments of the present disclosure without limitation. Additionally, the illustrated casement embodiment 300 in FIG. 3 does not indicate the means by which the embodiment is propelled open or extended outward. However, mechanisms for the opening the embodiment (e.g., sliders, rollers, spring loaded side arms, crank arms, motor powered arms, pneumatic arms, among others) are contemplated by embodiments of the present disclosure without limitation.

Panes may be present on each of the surfaces exposed to the exterior including the exterior portion 110, the vertical sections 370, the roof 320, and the platform 310. The present disclosure contemplates that each of these panes may be individually fixed in a closed position. In contrast, the present disclosure also contemplates that each of these panes may be individually openable through a variety of means. The panes may be openable by rotating about an attachment axis (for example attachment axis 640 in FIG. 6). The panes may also be openable by a sliding mechanism in which the panes translate horizontally at least a distance into their respective casings to provide at least a portion of open space in their respective surfaces. The panes may also be available as inserts in which the panes are removable to provide either open or closed portions of their respective surfaces.

According to the illustrated casement embodiment 300, the embodiment may initially be in a closed or retracted position as shown in FIG. 3. In such a position, the exterior portion 110 may be substantially flush with the exterior of the building while the roof 320, the platform 310, and the vertical sections 370 may extend into the interior of the building. In some embodiments, the vertical sections 370, the roof 320, and the platform 310, may be made of a collapsible material to reduce intrusion into the building's interior. In some embodiments, the vertical sections 370 may be detachable from the exterior portion 110, the roof 320, and the platform 310 to be stored while the casement embodiment 300 rests in a closed or retracted position. Similarly, in some embodiments, the roof 320 and/or the platform 310 may be detachable so as to be storable when the casement embodiment 300 rests in a closed or retracted position.

As will be appreciated from the description herein, the mechanism's 350 attachment along the length of the left casing member 113 or the right casing member 112 permits the exterior portion 110 to pivot about a vertical axis at a side of the window frame to extend into an open or extended position. The path of motion of the embodiment may follow a generally parabolic motion perpendicular to that of the exterior of the building in which the casement embodiment 300 is installed. As the embodiment is extended into an open position, the vertical sections 370 may extend outward to form sides of an enclosure. In a similar manner, the roof 320 and the platform 310 may extend outward as the embodiment extends outward to form the top and bottom of an enclosure, respectively. In some embodiments, the mechanism 350 may be a pivot rod to allow motion about a fixed end. As discussed above, the figures do not indicate the means by which the embodiment is propelled open or extended outward. However, mechanisms for opening the casement embodiment 300 (e.g., sliders, rollers, spring loaded side arms, crank arms, motor powered arms, pneumatic arms, among others) are contemplated by embodiments of the present disclosure without limitation. Although depicted as in a closed position in FIG. 3, the present disclosure contemplates the awning embodiment extending to any point along the path from a closed position to fully extended position.

With reference to FIGS. 19-20A, a casement embodiment 300 of the present disclosure is displayed in an open or extended position. As described in detail above, when the casement embodiment 300 is opened, the exterior portion 110 may rotate about mechanism 350 such that the left casing member 113 extends furthest outward from the exterior of the building in which the embodiment is installed. The vertical sections 370 may attached vertically between the roof 320 and platform 310 and in conjunction with the exterior portion 110, may create an enclosure.

With reference to FIG. 20A, a top cut away view along line C-C is depicted. As is evident in FIGS. 20A-20B, in some embodiments, the vertical sections may be dimensioned to nest inside one another to reduce intrusion into the interior of the building when the embodiment is in a closed or retracted position. FIG. 20B illustrates the method by which each vertical section 370 unit may attach to each subsequent vertical section. By way of example, the ends of the outward most vertical section may be grooved to attach to the adjacent vertical section. As seen in FIG. 20A, each vertical section 370, when in an open position, may be attached to an adjacent vertical section via grooves disposed on at least one vertical end of each vertical section. Additionally, as seen in FIG. 20B, the vertical sections 370, when in a close position, may be dimensioned to nest inside adjacent vertical sections.

It is preferred in casement embodiments that the interior edge of each vertical section 370 interacts with the exterior edge of the adjacent vertical section 370. For instance, in FIG. 20, the interior edge of each vertical section 370 has an inward projection that interacts with an outward projection of the exterior edge of the adjacent vertical section 370.

Figure 9A:
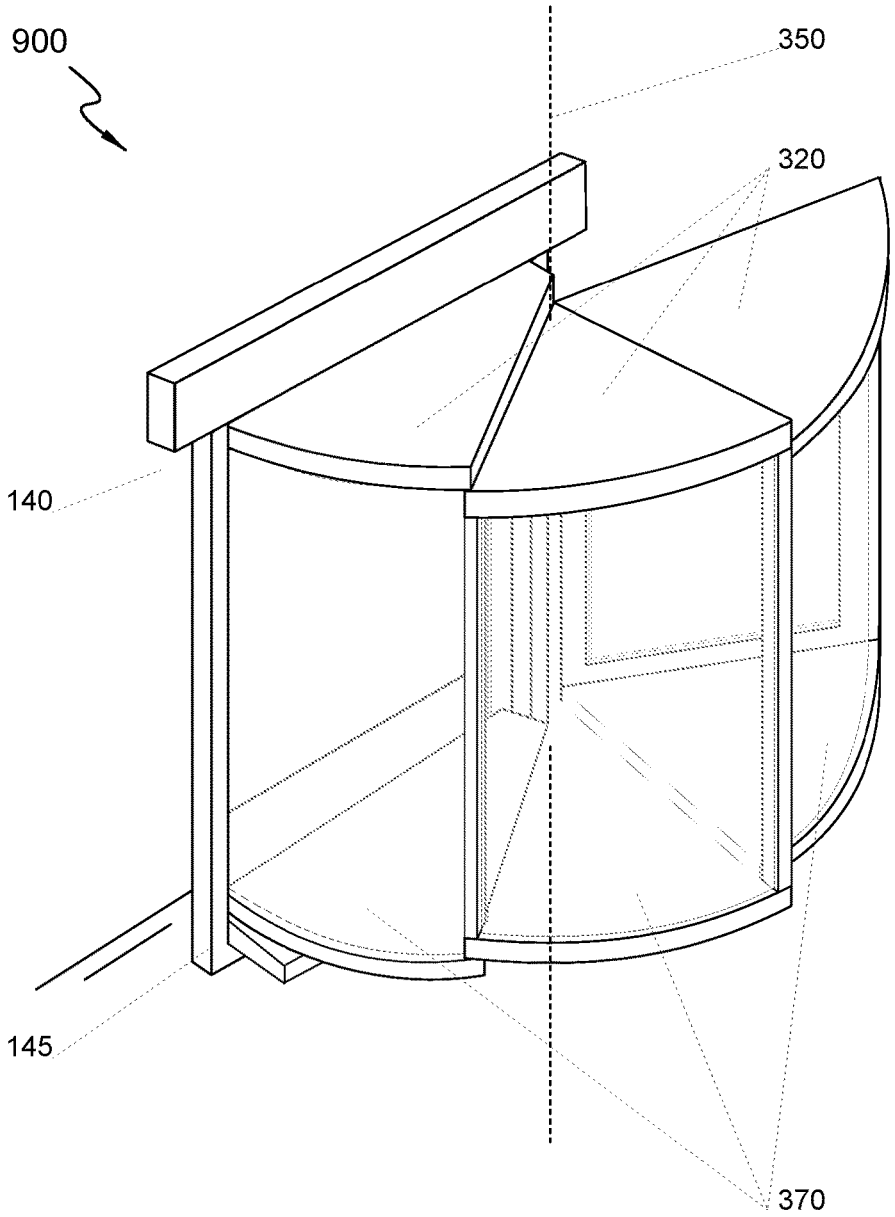
FIG. 9A illustrates a perspective view of an open casement embodiment of the present disclosure.
Figure 9B:
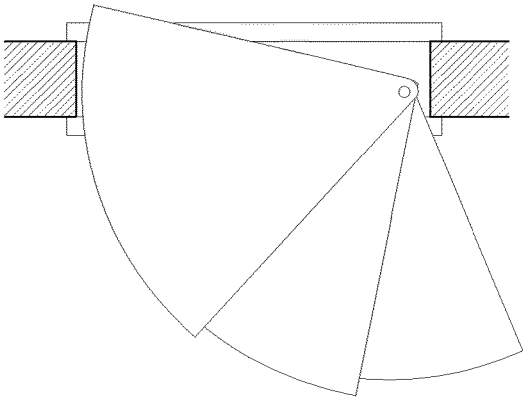
FIG. 9B illustrates a top view of the open casement embodiment of FIG. 9A of the present disclosure.

With reference to FIGS. 9A-9B, a casement embodiment 900 of the present disclosure is illustrated mounted in a window frame between the head 140 and the sill 145 of the window frame, and displayed in an open or extended position. The casement embodiment 900 in FIG. 9 illustrates three vertical sections 370 and a roof 320 made up of 3 sections attached atop of each vertical section 370. In such an embodiment, the inward most vertical section may be dimensioned such that the middle vertical section may nest within the center vertical section when in a closed position. Likewise, the center vertical section may be dimensioned such that the outward vertical section may nest within the center vertical section when the embodiment is in a closed position.

Figure 9C:
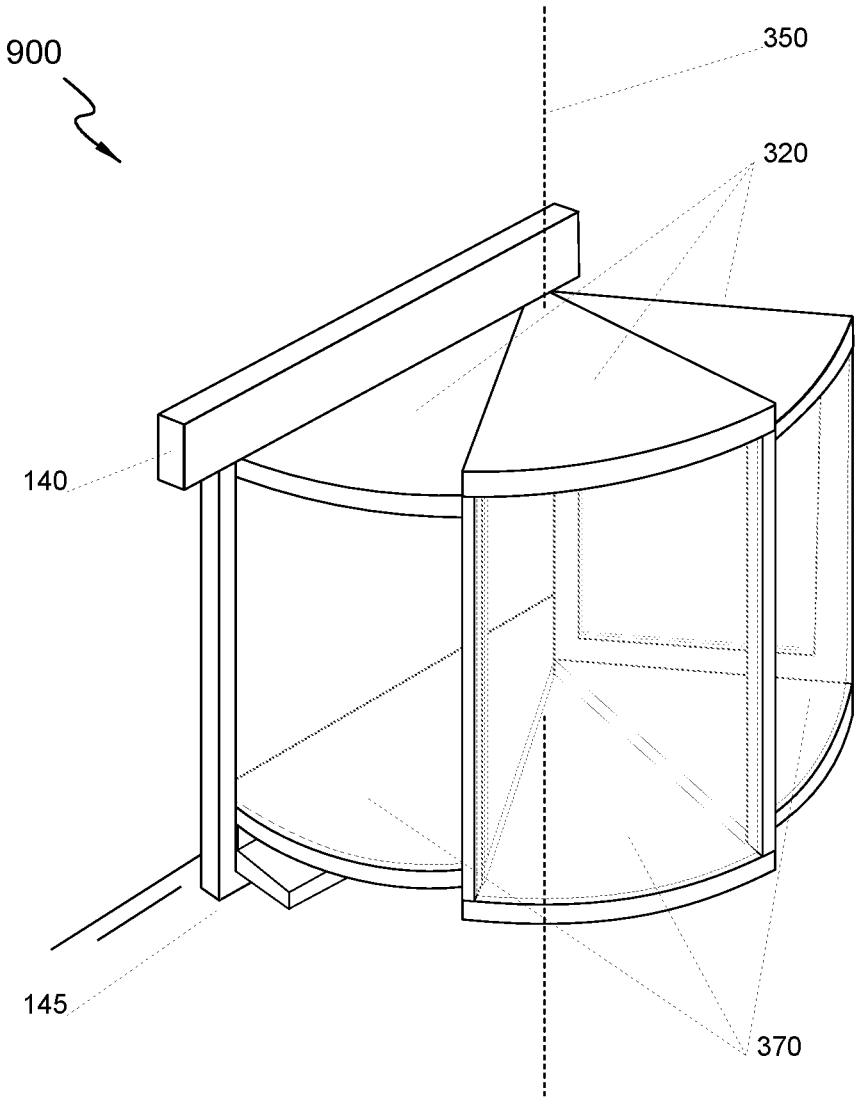
FIG. 9C illustrates a perspective view of an alternative open casement embodiment of the present disclosure.
Figure 9D:
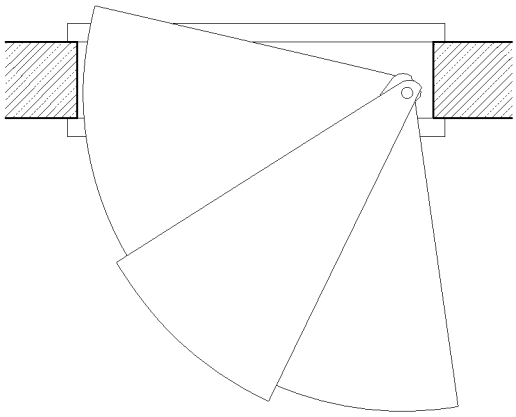
FIG. 9D illustrates a top view of the open casement embodiment of FIG. 9C of the present disclosure.

With reference to FIGS. 9C-9D, a casement embodiment 900 of the present disclosure is illustrated mounted in a window frame between the head 140 and the sill 145 of the window frame, and displayed in an open or extended position. The casement embodiment 900 in FIG. 9 illustrates three vertical sections 370 and a roof 320 made up of 3 sections attached atop of each vertical section 370. In such an embodiment, the center vertical section may be dimensioned such that the inward and outward vertical sections may nest within the center vertical section. Although depicted with the inward and outward vertical sections capable of nesting within the center vertical section, any vertical section 370 may be dimensioned such that the other vertical sections nest within that single vertical section. When in an open or extended position, the vertical sections 370 may each extend exterior of the building and provide a graduated enclosure. When the casement embodiment 900 is in a closed or retracted position, the vertical sections 370 may nest inside a single vertical section in order to reduce intrusion into the interior of the building. Similarly the roof 320 sections may extend outwardly when the casement embodiment 900 is in an open position and may nest within a single roof section for storage when in a closed or retracted position.

Figure 9E:
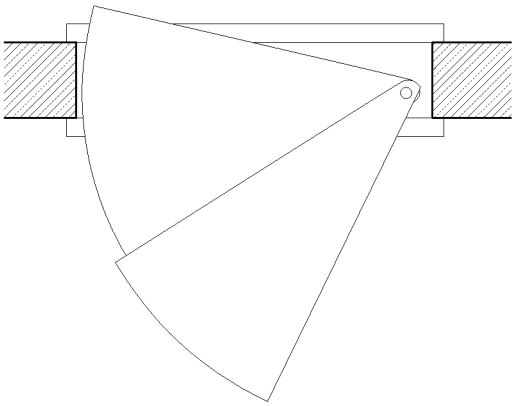
FIG. 9E illustrates a top view of a partially open casement embodiment of the present disclosure.
Figure 9F:
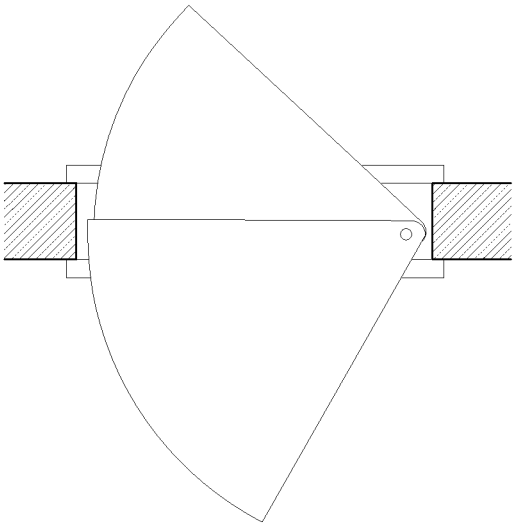
FIG. 9F illustrates a top view of a partially open alternative casement embodiment of the present disclosure.
Figure 9G:
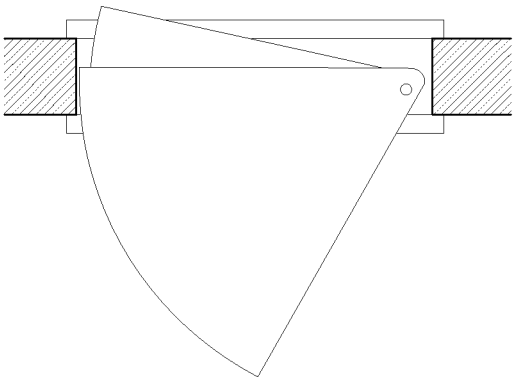
FIG. 9G illustrates an alternative top view of the partially open casement embodiment of FIG. 9F of the present disclosure.

With reference to FIGS. 9E-9G, a top view of a partially opened casement embodiment comprising at least two sections is illustrated. As seen in these figures, the casement embodiment may pivot about a fixed end, and may have sections of various dimensions depending upon the structure in which the embodiment is installed or user-preference.

Hopper Embodiment

Figure 4:
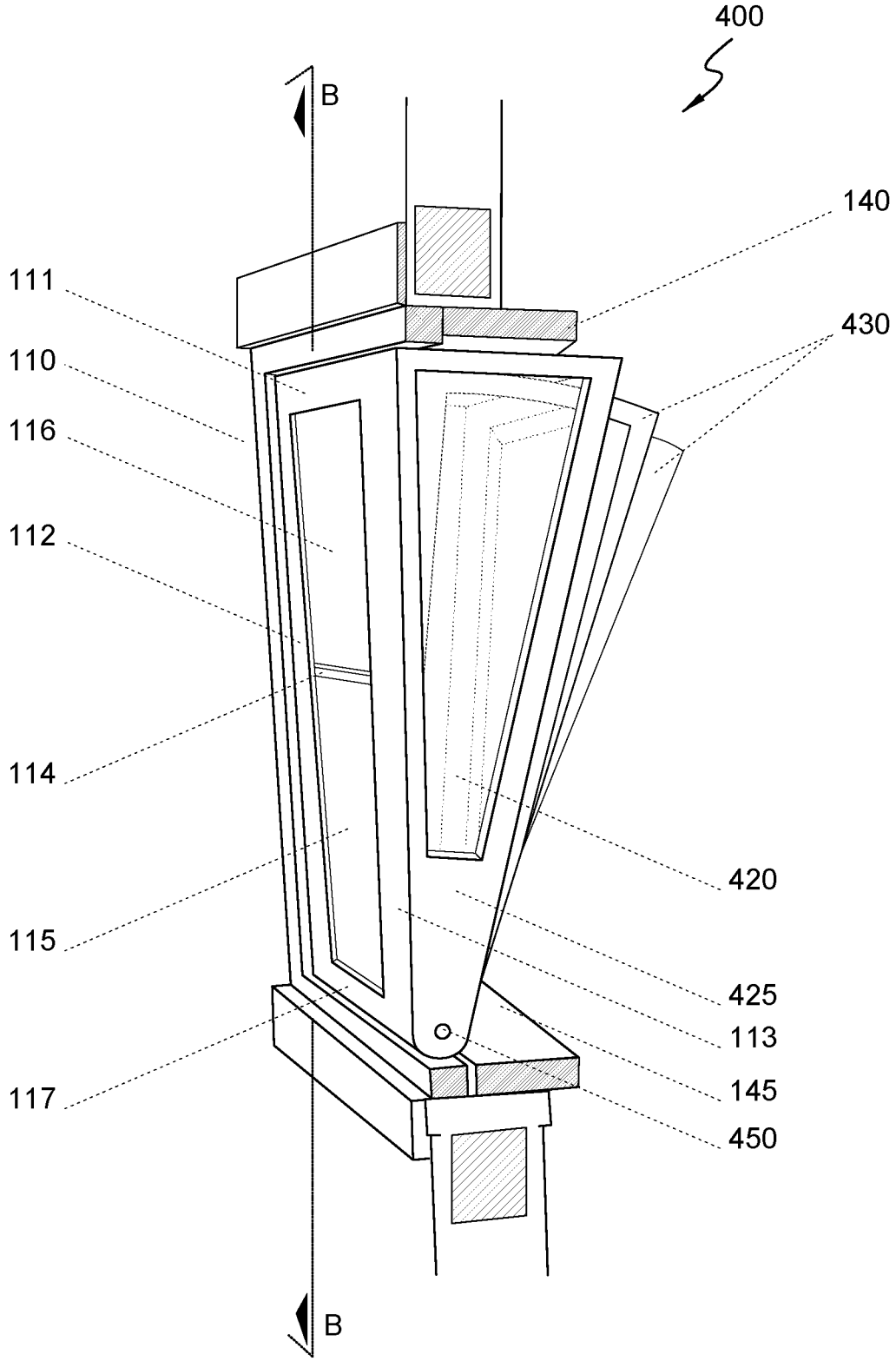
FIG. 4 illustrates a perspective view of a closed hopper according to a further example embodiment of the present disclosure.

FIG. 4 illustrates a hopper embodiment 400 of the present disclosure in a closed or retracted position mounted in a window frame between the head 140 and the sill 145. As shown in FIG. 4, the hopper embodiment 400 may include an exterior portion 110, expansion units 430, a top portion, and a mechanism 450. As described in greater detail below, the exterior portion 110 may include a head casing member 111, a bottom casing member 117, a left casing member 112, a right casing member 113, and panes 115 and 116 separated by a mullion 114. Each expansion unit 430 may include a left side panel, a right side panel, a left side pane, and a right side pane. The top portion of each expansion unit 430 may include a top panel and a top pane.

With reference to FIG. 4, a hopper embodiment 400 of the present disclosure is illustrated mounted in a window frame between the head 140 and the sill 145 of the window frame, and the embodiment is displayed in a closed or retracted position. In the illustrated embodiment, the exterior portion 110 may be comprised of a casing which includes a head casing member 111, a left casing member 112, a right casing member 113, and a bottom casing member 117. The exterior portion 110 may be formed to resemble a window by the left casing member 112 and the right casing member 113 connected vertically between the head casing member 111 and the bottom casing member 117 to create a rectangular shape. These members may be secured to one another with any appropriate fasteners (e.g., screws, nails, bolts, staples, adhesives, among others). The head casing member 111 and bottom casing member 117 may be positioned at the top and bottom of the window frame, respectively. These casing members may be formed from any suitable structural window material (e.g., vinyl, wood, vinyl aluminum, composite plastic, fiberglass, among others).

The exterior portion 110 may have panes 115 and 116. These panes may be installed in the space created by the connection of the head casing member 111, the left casing member 112, the right casing member 113, and the bottom casing member 117. These panes may be configured to fill the open space created by the connection of the above listed casing members. In some embodiments, pane 115 and pane 116 may have the same dimensions. In some embodiments, pane 115 and pane 116 may have different dimensions. The exterior portion 110 may have a mullion 114 that extends horizontally to connect between the left casing member 112 and the right casing member 113. The mullion 114 may form a separation between pane 115 and pane 116. Although illustrated with two panes of relatively equal dimensions in FIG. 4, the exterior portion 110 may include a single pane that fills the entire space created by the connection of the head casing member 111, left casing member 112, right casing member 113, and bottom casing member 117. Although the illustrated exterior portion 110 example in FIG. 4 is shown with two panes 115 and 116, other pane configurations (e.g., single pane, double pane, four-over-four, four-over-one, six-over-six, six-over-one, among others) are contemplated by the embodiments of the present disclosure without limitation. The exterior portion 110 may resemble a window and may be substantially flush with the exterior of the building's facade in which the hopper embodiment 400 is installed when in a closed position. The hopper embodiment 400 may have expansion units 430 defining panels and panes (for example right side panel 425 and right side pane 420).

Figure 5:
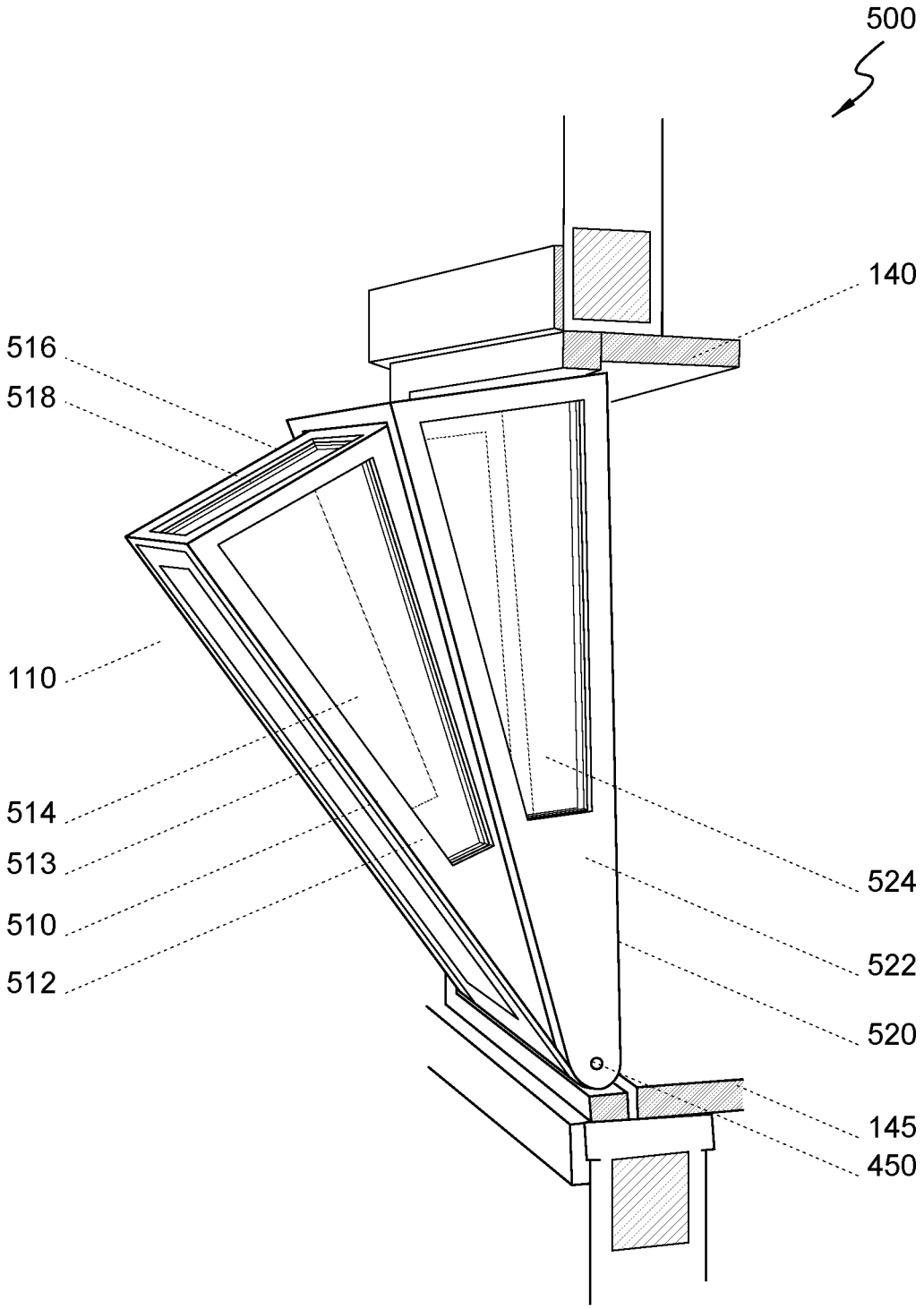
FIG. 5 illustrates a perspective view of an open hopper embodiment of FIG. 4 of the present disclosure.

FIG. 5 displays the hopper embodiment of the present disclosure in an open or extended position. This embodiment is mounted in a window frame between the head 140 and the sill 145. With reference to FIG. 5, a hopper embodiment of the present disclosure may include expansion units (Expansion units 430 in FIG. 4). Each expansion unit may be comprised of a left side panel, a right side panel, a left side pane, and a right side pane. A first expansion unit 520 may have a right side panel 522 and a right side pane 524. The first expansion unit 520 may also have a left side panel and a left side pane on the opposite vertical side of the first expansion unit 520, not shown in FIGS. 4-5. As indicated by FIG. 5, the inward vertical edge of the right side panel 522 may be attached to the right casing member 113 of the exterior portion 110. In a similar configuration, the inward vertical edge of the left side panel, not shown, may be attached to the left casing member 112 of the exterior portion 110. The outward vertical edge of the of the left side panel 522 of the first expansion unit 520 may be attached to the inward vertical edge of the left side panel 512 of the second expansion unit 510. In a similar configuration, the outward vertical edge of the right side panel of the first expansion unit 520 may be attached to the inward vertical edge of the right side panel of the second expansion unit 510. This attachment is not shown in FIGS. 4-5.

In some embodiments, the attachment between the first expansion unit 520 and the second expansion unit 510 may be such that the second expansion unit 510 is graduated in size such that the second expansion unit may nest within the first expansion unit 510 when the hopper embodiment 500 is in a closed or retracted position. As shown in FIG. 5, the second expansion unit 510 may be attached to the exterior portion 110 of the hopper embodiment 500. The outward vertical edge of the right side panel 512 of the second expansion unit 510 may be attached to the right casing member 113 of the exterior portion 110. Although not shown in FIGS. 4-5, the outward vertical edge of the left side panel of the second expansion unit 510 may be attached to the left casing member 112 of the exterior portion 110. In some embodiments this attachment may be substantially orthogonal with respect to the exterior portion 110.

In some embodiments, the inward vertical edge of the right side panel 522 and the right side panel of the first expansion unit 520 may be substantially flush with the exterior of the building's facade when the hopper embodiment is in an open or extended position. The outward vertical edge of the right side panel 512 and the right side panel of the second expansion unit 510 may be substantially flush with the exterior of the building's facade when the hopper embodiment 500 is in a closed or retracted position. In some embodiments, the expansion units may extend into the interior of the building when the hopper embodiment 500 is in a closed or retracted position. The bottom end of the first expansion unit 520 and the second expansion unit 510 may attach to a mechanism 450 described hereinafter. The upper edge of the right side panel 522 and the left side panel (not shown) may attach to a top panel of the top portion of the hopper embodiment 500. By way of example, the upper edge of the right side panel 512 of the second expansion unit 510 may be attached to a top panel 516. Each of these members may be secured to one another with any appropriate fasteners (e.g., screws, nails, bolts, staples, adhesives, among others) and may be formed from any suitable material for window construction (e.g., vinyl, wood, vinyl aluminum, composite plastic, fiberglass, among others). In some embodiments, the left side panels, the right side panels, and the top panels may be formed from a collapsible or foldable material (e.g., canvas, vinyl, among others). Although only two expansion units are shown in FIG. 5, the present disclosure contemplates any number of expansion units without limitation.

The expansion units (depicted as expansion units 430 in FIG. 4), may each have a left side pane and right side pane in the left side panel and the right side panel, respectively. The left side pane and the right side pane may be configured to occupy an area up to the size of its respective side panel. Although the illustrated embodiment in FIG. 5 displays a single pane configuration for the side panels, other configurations (e.g., double pane, four-over-four, four-over-one, six-over-six, six-over-one, among others) are contemplated by the embodiments of the present disclosure without limitation.

A hopper embodiment of the present disclosure may include a top portion. In the illustrated embodiment, the top portion may be comprised of top panels for each expansion unit with each top panel having a top pane. By way of example, a second expansion unit 510 of hopper embodiment 500 may have a top panel 516 with a top pane 518. The first expansion unit 520 of hopper embodiment 500 may also have a top panel and a top pane. The top panel of each expansion unit may be attached to the upper edges of the left side panel and right side panel of its respective expansion unit. The top panel 516 of the second expansion unit 510 may attach along its outward edge with the head casing member 111. The attachment between these above described members may be such that an enclosure is created. These members may be secured to one another with any appropriate fasteners (e.g., screws, nails, bolts, staples, adhesives, among others). These casing members may be formed from any suitable structural window material (e.g., vinyl, wood, vinyl aluminum, composite plastic, fiberglass, among others). In some embodiments, the top portion may be formed from a collapsible or foldable material (e.g., canvas, vinyl, among others). Each top panel of each expansion unit may have a pane. By way of example, pane 518 may be configured to occupy an area up to the size of its respective side panel. Although the illustrated embodiment in FIG. 5 displays a single pane configuration for the top panels, other configurations (e.g., double pane, four-over-four, four-over-one, six-over-six, six-over-one, among others) are contemplated by the embodiments of the present disclosure without limitation.

A hopper embodiment of the present disclosure may include a mechanism 450. The mechanism 450 may be attached at a point at the bottom of the left side panel and the right side panel of the expansion units and may be attached along its length to the casing member 117 of the exterior portion 110. In some embodiments, this mechanism 450 may be a pivot rod to allow for the opening of the hopper embodiment 500. The bottom of the hopper embodiment 500, through the left side panel, the right side panel and the casing member 117, may be pivotally connected to a pivot rod mounted near the bottom of the window frame perpendicular to the opening motion of the hopper embodiment. Although the illustrated example utilizes a pivot rod at the bottom of the window frame as the mechanism 450, other mechanisms allowing motion about a fixed end (e.g., hinges, socket joints, among others) are contemplated by the embodiments of the present disclosure without limitation. Additionally, the illustrated hopper embodiment 500 in FIG. 5 does not indicate the means by which the embodiment is propelled open or extended outward. However, mechanisms for the opening the embodiment (e.g., sliders, rollers, spring loaded side arms, crank arms, motor powered arms, pneumatic arms, among others) are contemplated by embodiments of the present disclosure without limitation.

In some embodiments, the mechanism 450 may include at least one gear driven crank system. In such an embodiment, each expansion unit may be movably connected to an independent crank system. By way of example, a hopper embodiment with three expansion units may have three crank systems to independently extend or retract each expansion unit. In such an embodiment, a first expansion unit may be attached to a first crank system, a second expansion unit may be attached to a second crank system, and a third expansion unit may be attached to a third crank system. A user may choose to crank any combination of the described first, second, or third crank system to extend or retract the hopper embodiment to any point along the path from a closed position to fully open position.

With reference to FIGS. 23A-23B, an enlarged view of a sample mechanism 450 attached to a hopper embodiment is depicted. FIG. 23 displays a rotating member 2305 which may be utilized by some hopper embodiments to reduce intrusion into the interior of the building. This rotating member may be a bottom window member discussed above. For example, in some embodiments, the rotating member 2305 may be attached to sill 145 and may pivot about pivot point 450. The upward rotation of this rotating member may be such that a bottom window member may lie substantially parallel with the exterior portion 110.

Panes may be present on each of the surfaces exposed to the exterior including the left and right panels of each extension unit, the top panel of each extension unit 516, and the exterior portion 110. The present disclosure contemplates that each of these panes may be individually fixed in a closed position. In contrast, the present disclosure also contemplates that each of these panes may be individually openable through a variety of means. The panes may be openable by rotating about an attachment axis (for example attachment axis 640 in FIG. 6). The panes may also be openable by a sliding mechanism in which the panes translate horizontally at least a distance into their respective casings to provide at least a portion of open space of their respective surfaces. The panes may also be available as inserts in which the panes are adjustable or removable to provide either open or closed portions of their respective surfaces.

With respect to FIG. 4, the hopper embodiment 400 of the present disclosure is illustrated in a closed, or retracted position. In a closed position, the exterior portion 110 may be substantially flush with the exterior of the structure in which the embodiment is mounted. From the exterior of the structure, the exterior casing including the head casing 111, the left casing member 112, the right casing member 113, and the bottom casing member may be visible. As shown in FIG. 4, the expansion units and top portion may extend into the interior of the building when the hopper embodiment 400 is in a closed position. The present disclosure contemplates a variety of means for storage of the expansion units 430 and the top portion of the hopper embodiment 400. In some embodiments, the expansion units 430 and the top panels may be made of a collapsible material to reduce intrusion into the building's interior. In some embodiments, the expansion units 430 and top portion may be detachable from the exterior portion 110 and the mechanism 450 to be stored while the hopper embodiment rests in a closed or retracted position.

As will be appreciated from the description herein, the mechanism's 450 attachment along the length of casing member 117 permits the exterior portion 110 to pivot about the bottom end of the window frame to extend into an open position as shown in FIG. 5. The path of motion of the embodiment may follow a generally parabolic motion perpendicular to that of the exterior of the building in which the hopper embodiment is installed. As the embodiment is extended into an open position, the expansion units may extend outward to form sides of an enclosure. In a similar manner, the top panels may extend outward as the embodiment extends outward to form the top of an enclosure. In some embodiments, the expansion units may nest when the embodiment is in a closed or retracted position. In such an embodiment, the expansion units may fan outwardly as the embodiment is extended to an open position. In some embodiments, the mechanism 450 may be a pivot rod to allow motion about a fixed end. As discussed above, the figures do not indicate the means by which the embodiment is propelled open or extended outward. However, mechanisms for opening the hopper embodiment 400 (e.g., sliders, rollers, spring loaded side arms, crank arms, motor powered arms, pneumatic arms, among others) are contemplated by embodiments of the present disclosure without limitation. Although depicted as in a fully closed and fully extended position in FIGS. 4-7, the present disclosure contemplates the hopper embodiment being able to extend and be along any point positioned securely along the path from a closed position to fully extended position.

Figure 6:
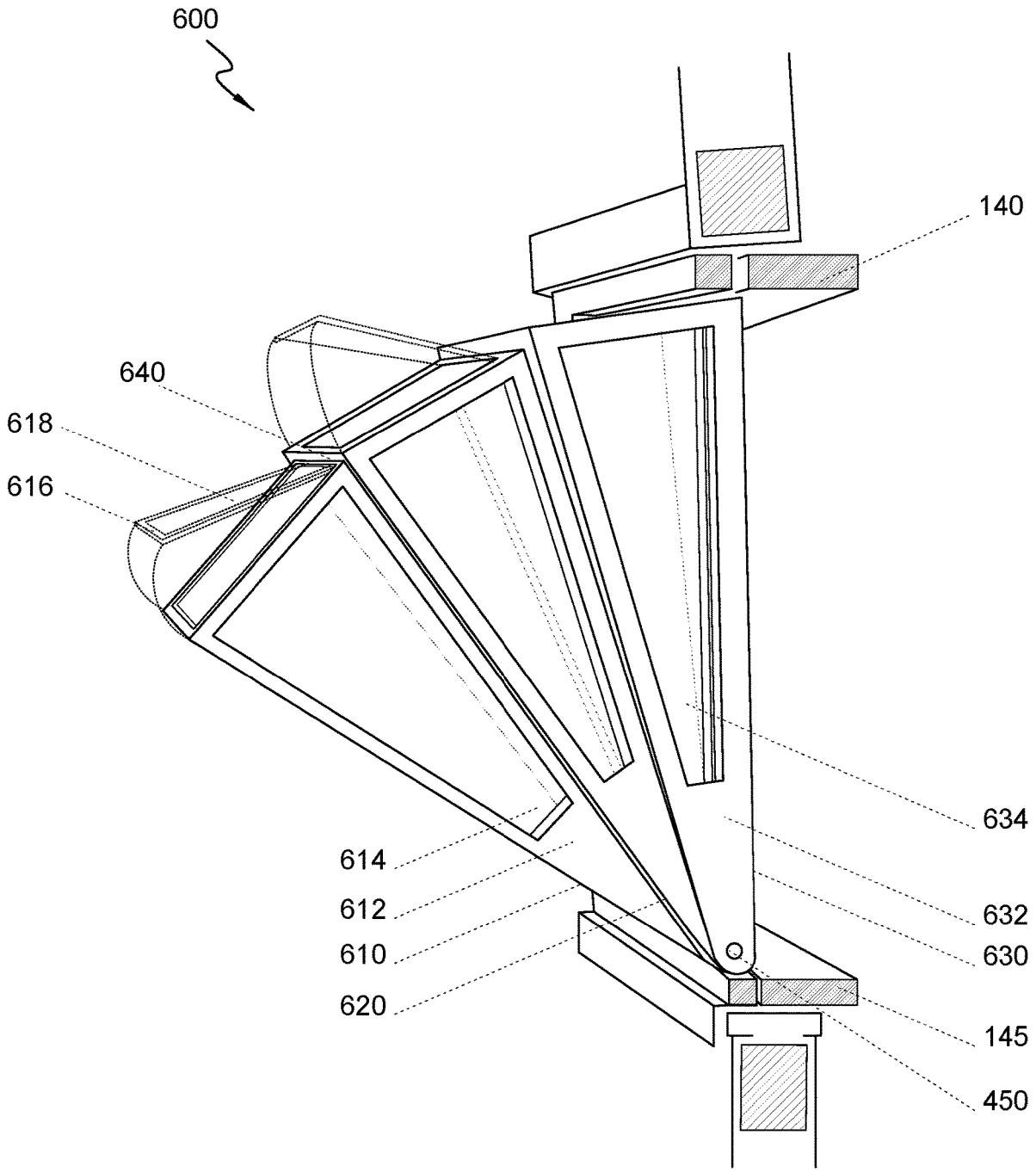
FIG. 6 illustrates a perspective view of an open hopper according to a still further embodiment of the present disclosure.

With reference to FIG. 6, a hopper embodiment 600 of the present disclosure is illustrated with three expansion units mounted in a window frame between the head 140 and the sill 145 and displayed in an open position. As shown in FIG. 6, the hopper embodiment 600 may include expansion units, a top portion, and a mechanism 450. Each expansion unit may include a left side panel, a right side panel, a left side pane, and a right side pane. The top portion of each expansion unit 430 may include a top panel and a top pane. FIG. 6 displays a first expansion unit 630 with a right side panel 632 and a right side pane 634, a second expansion unit 620 with a right side panel 622 and a right side pane 624, and a third expansion unit 610 with a right side panel 612 and a right side pane 614. Each of the above listed expansion units may have a left side panel and a left side pane not shown in FIG. 6. In a similar configuration to the embodiment described in FIG. 5, the hopper embodiment 600 may be movable connect to a mechanism 450 at the bottom of the expansion units. Similarly, the expansion units displayed in an open position may nest one inside the other when the embodiment is in a closed or retracted position. For example, the third expansion unit 610 may be sized as to fit inside the second expansion unit 620. Additionally, the second expansion 620 unit may be sized as to fit inside the first expansion unit 630. In some embodiments, as shown in FIG. 6, the top panel 616 of an expansion unit may be openable by rotating about an attachment axis 640. The present disclosure contemplates that the top panel or top pane of each expansion unit may be openable by rotation or movement about an axis.

Figure 7:
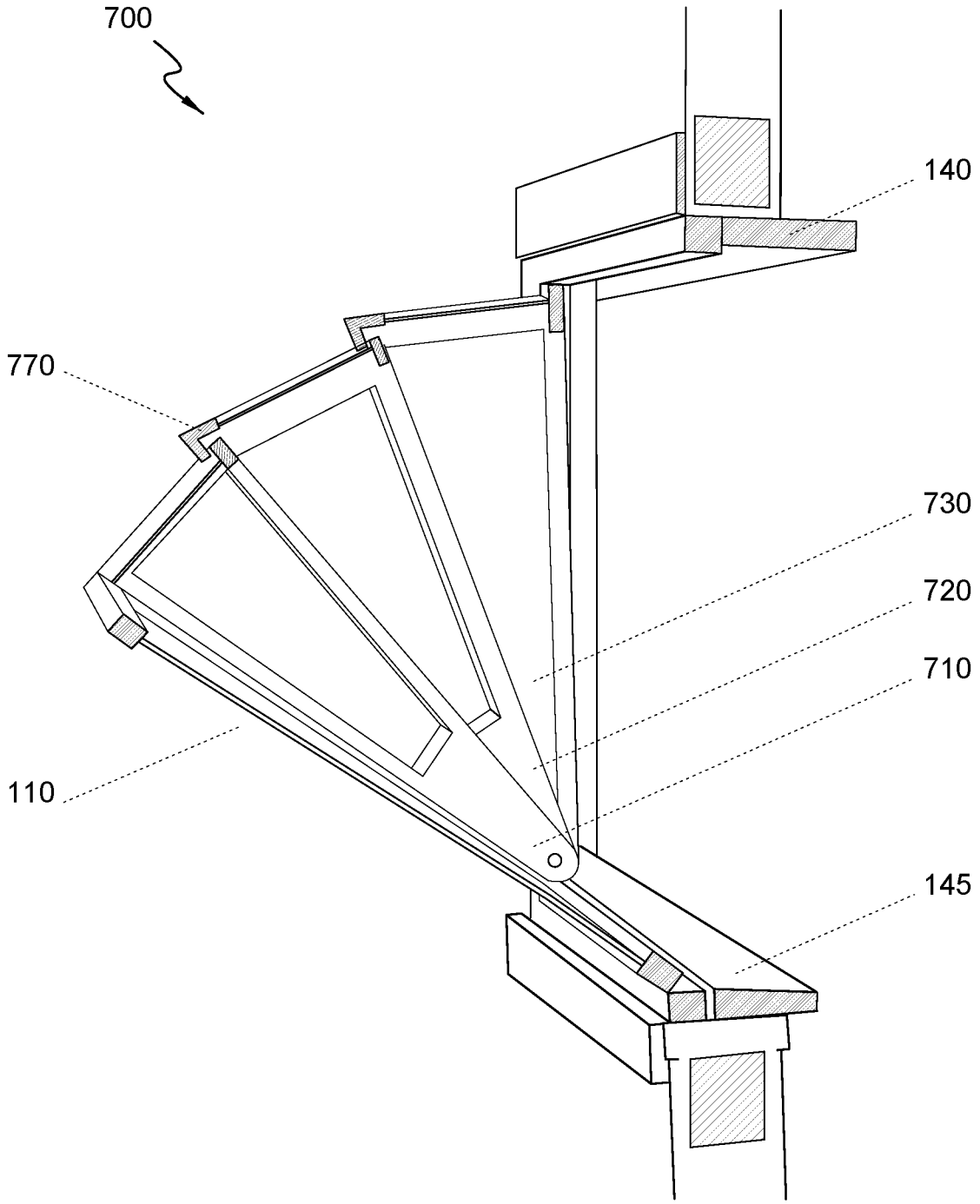
FIG. 7 illustrates a cut-away view of an open hopper embodiment of FIG. 6, along line B-B in FIG. 4, of the present disclosure.

With reference to FIG. 7, a hopper embodiment 700 of the present disclosure is illustrated in a cut-away view along line B-B in FIG. 4 with three expansion units mounted in a window frame between the head 140 and the sill 145 and displayed in an open position. FIG. 7 illustrates a cut-away view of a hopper embodiment 700 of the present disclosure showing the unseen right side panels as referenced in FIGS. 4-6. The left side panel 730 in the first expansion unit, the left side panel 720 in the second expansion unit, and the left side panel 710 in the third expansion unit are illustrated in this cut-away view. Each of the right side panels in this embodiment may also have a right side pane in their respective panel.

In a preferred hopper embodiment, the inward edge of each expansion unit interacts with the outward edge of the adjacent expansion unit. For instance, in FIG. 7, the inward edge of expansion unit 710 has an upward projection 770 that interacts with an overlapping portion of expansion unit 720 to limit the movement of expansion unit 710.

With reference to FIG. 8, an interior view of a large hopper embodiment according of the present disclosure is illustrated. In some embodiments, the dimensions of a hopper embodiment 800 may be large enough to house several persons when in an open or extended position. Similar to the above described hopper embodiments in FIGS. 4-7, the illustrated hopper embodiment 800 may have an exterior portion, expansion units, and a top portion that extends to open in the same manner as the above described embodiments. Additionally FIGS. 21-22 provide an interior and exterior view of a large hopper embodiment, respectively. Such embodiments may be operate similar to smaller hopper embodiments detailed above, but may be dimensioned to hold or support multiple individuals in a defined space. Additionally, such large hopper embodiments 800 may provide a seat members 2110 positioned along the bottom of the embodiment. The present disclosure contemplates that the structural strength of the members utilized in large hopper embodiment 800 may need to be substantially stronger in order to safely support the combined weight of multiple individuals.

Figure 10:
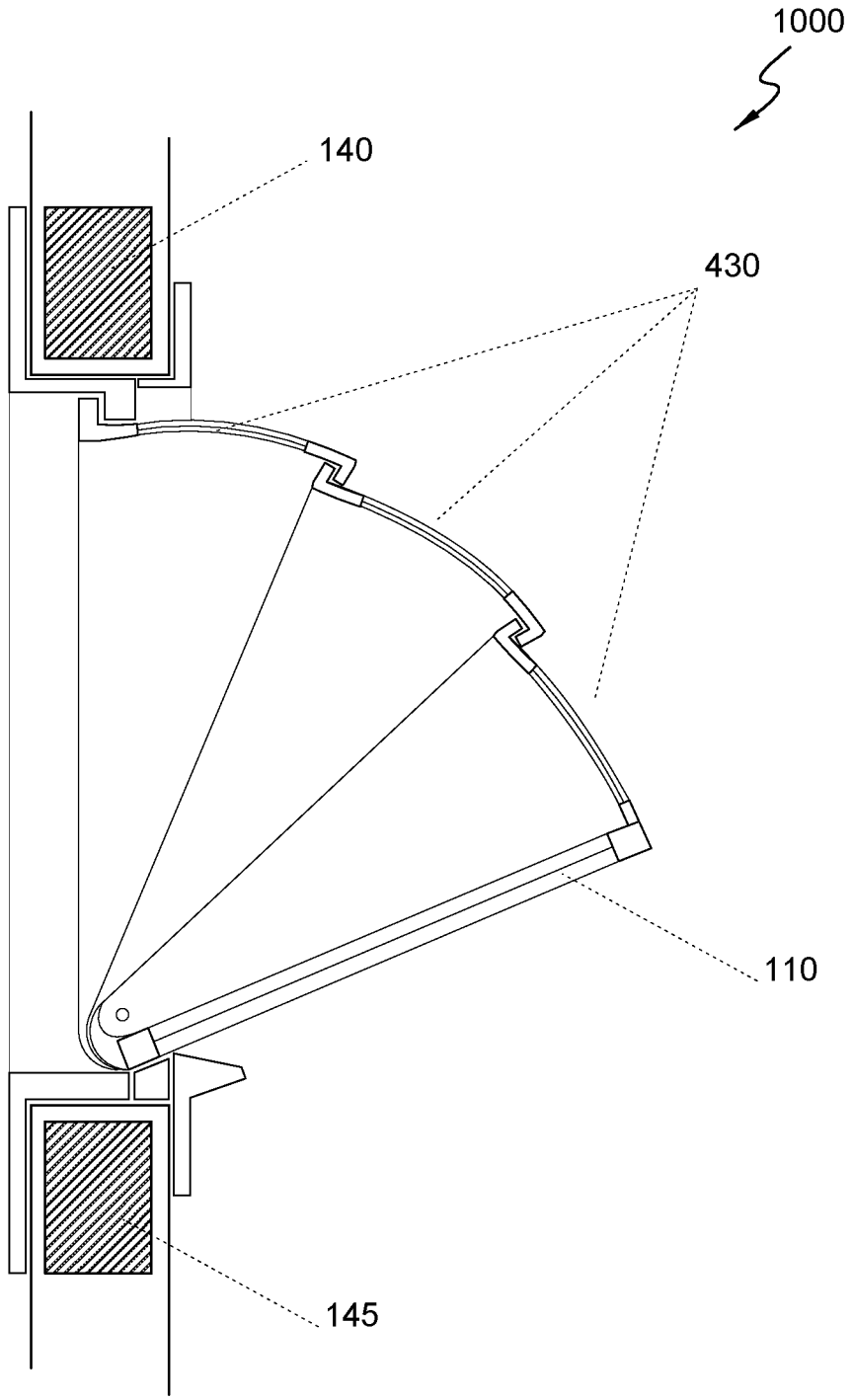
FIG. 10 illustrates a cut-away view of an alternative open hopper embodiment of the present disclosure.

With reference to FIG. 10, a cut-away view of an open hopper embodiment 1000 along line B-B is illustrated mounted in a window frame between the head 140 and the sill 145. The hopper embodiment 1000 is shown with three expansion units 430 and an exterior portion 110. In such an embodiment, the expansion units 430 may be dimensioned, as described above, to nest in side one another to reduce the intrusion into the interior of the building when the embodiment is in a closed or retracted position. FIG. 10 illustrates the method by which each expansion unit 430 may attach to the subsequent expansion unit. By way of example, the top of the outward expansion unit may be grooved to attach to the center expansion unit. Similarly the top of the center expansion unit may be grooved to attach to the inward expansion unit and the top of the inward expansion unit may be grooved to attach to the head 140 of the window frame.

With reference to FIG. 14A-14C, a hopper embodiment 1400 of the present disclosure is illustrated mounted in a window frame between the head 140 and the sill 145 and displayed in an open position. The hopper embodiment 1400 is depicted with an exterior portion 110, a single expansion unit 430, and a top panel 616. As shown in FIG. 14 the present disclosure contemplates that in some embodiments, the exterior portion 110 may have a semicircular radius window on top of a rectangular shaped window (e.g., a Norman window). In such an embodiment, the top panel 616 may be a semicircular dome shape. When the hopper embodiment 1400 is in an open or extended position, the exterior portion 110, expansion unit 430, and the top panel 616 may be connected such to create an enclosure. In some embodiments, the exterior portion 110 may be substantially flush with the building's facade when the hopper embodiment 1400 is in a closed or retracted position. When the hopper embodiment 1400 is in a closed or retracted position, the top panel 616 and expansion unit 430 may extend into the interior of the building. The present disclosure contemplates a variety of means for storage of the top panel 616 and expansion unit 430 in order to reduce intrusion into the interior of the building when the hopper embodiment 1400 is in a closed or retracted position. The present disclosure contemplates that the top panel 616 and expansion unit 430 may be detachable from the hopper embodiment 1400 and storable until needed for use in an open position.

With reference to FIGS. 15A-15B, a further alternative hopper embodiment 1500 of the present disclosure is illustrated mounted between the head 140 and sill 145 and displayed in an open position. The hopper embodiment 1500 is depicted without side panels or top panels, and associated panes, similar to those found in FIG. 6. Instead, hopper embodiment 1500 utilizes a single expansion unit 1505 connected between the head 140 and the exterior portion 110. As discussed above in detail, the exterior portion 110 may resemble a conventional window. As shown in FIG. 15*a*-15*b*, the expansion unit 1505 attaches at the top of the window frame in which it is installed, at the head 140, and at the top of the exterior portion 110. In a similar configuration to the embodiment described in FIGS. 5-6, the hopper embodiment 1500 may be movable connected to a mechanism 450 at the bottom of the exterior portion 110. As will be appreciated from the description herein, the mechanism's 450 attachment along the exterior portion 110 allows the exterior portion 110 to pivot about the bottom end of the window frame to extend into an open position as shown in FIG. 15*a*-15*b*. The path of motion of the embodiment may follow a generally parabolic motion perpendicular to that of the exterior of the building in which the hopper embodiment 1500 is installed. As the embodiment is extended into an open position, the expansion unit 1505 may accordion outward to form an enclosure.

Extending Embodiment

With reference to FIGS. 17A-17B, an extending embodiment 1700 of the present disclosure is illustrated mounted in a window frame between the head 140 and the sill 145 of the window frame, and the embodiment is displayed in different stages of open positions. In the illustrated embodiment, the exterior portion 110 may be comprised of a casing which includes head, left, right, and bottom casing members. The exterior portion 110 may be formed to resemble a window by the left casing member and the right casing member connected vertically between the head casing member and the bottom casing member to create a rectangular shape. These members may be secured to one another with any appropriate fasteners (e.g., screws, nails, bolts, staples, adhesives, among others). The top and bottoms (e.g., the head and bottom casing members, respectively) of the exterior portion 110 may be positioned at the top and the bottom of the window frame, respectively. These casing members may be formed from any suitable structural window material (e.g., vinyl, wood, vinyl aluminum, composite plastic, fiberglass, among others).

With continued reference to FIGS. 17A-17B, the extending embodiment 1700 of the present disclosure may also include a first extending unit 1705 and a second extending unit 1710. Similar to the expansion units found in an example hopper embodiment (e.g., expansion unit 430 in FIG. 4), when the extending embodiment 1700 is in an open position, the first extending unit 1705 my extend exterior of the building in which it is mounted. Similarly, the second extending unit 1710 may also extend exterior of the building in which it is mounted. These extending units may independently open or extend, and may both be in an extended position as shown in FIG. 17B. In some embodiments, the second extending unit 1710 may nest within the first extending unit similar to the expansion units found in the hopper embodiments described above. In such an embodiment, the second extending unit 1710 may be dimensioned such that it may be stored within the first extending unit 1705. In some other embodiments, the second extending unit may pivot about a fixed point located on the bottom of the second extending unit 1710 such that the second extending unit rests at an obtuse angle relative to the building in which it is installed. The second extending unit 1710 may be attached to a mechanism 1750 (e.g., hinged) which allows for the second extending unit to pivot. In such an embodiment, the bottom members of both the first extending unit 1705 and the second extending unit 1710 may comprise a first hinge 1755 and a second hinge 1755 to facilitate the pivoting of the second extending unit 1710. In an alternative embodiment not shown, the second extending unit 1710 may pivot about a fixed edge located along the inward bottom edge of the second extending unit 1710 such that the second extending unit 1710 is tilted relative to the first extending unit 1705.

With reference to FIGS. 17C-17E, the extending embodiment 1700 of the present disclosure may translate in a plane substantially orthogonal to the building in which it is installed. By way of example, FIG. 17C displays the extending embodiment 1700 in a closed or retracted state. In such a state, both the first extending unit 1705 and the second extending unit 1710 are nested and located within the interior of the building in which the system is installed. FIG. 17D displays the extending embodiment 1700 at a state in which the first extending unit 1705 has translated a distance exterior of the building but the second extending unit 1710 remains nested within the first extending unit 1705. FIG. 17E illustrates the extending embodiment 1700 is a fully extended or opened state where the first extending unit 1705 has translated to the exterior of the building and the second extending unit 1710 has extended and tilted relative the first extending unit 1705 via the second hinge 1755.

As would be understood in light of the above described figures and nature of the invention, the second extending unit 1710 may pivot about the fixed end by utilizing any mechanisms allowing motion about a fixed end (e.g., hinges, socket joints, among others) which are contemplated by the embodiments of the present disclosure without limitation. Additionally, the translation of the extending units exterior of the building may also be accomplished by any mechanism which allows translation in at most two directions (e.g., sliders, rollers, bearings, etc.).

With reference to FIGS. 24, 25A, 25B, and 26, various drawings of views of embodiments discussed herein positioned and placed in various possible structures. In particular, FIG. 24 illustrates a hopper embodiment (e.g., hopper embodiment 500 in FIG. 5) installed in a detached structure and displayed in an open position. With reference to FIG. 25A, various casement embodiments (for example casement embodiment 300 in FIG. 3) installed in a multi-unit dwelling (e.g., an apartment building or the like), and displayed in open, partially open, and closed positions. Additionally, FIG. 25B illustrates a multi-unit dwelling with various hopper embodiments installed. With reference to FIG. 26, a sample environment with awning, casement, and hopper embodiments illustrated in open and closed positions is illustrated.

The present disclosure contemplates that in any embodiment one or more of the surfaces between the window of the present disclosure and the frame in which it is mounted may include a weatherproof seal. Additionally, the present disclosure further contemplates that in any embodiment any contact surface which may be exposed to the exterior of the building or exposed to the weather is of a water tight design and may include a weatherproof seal.

Panes may be present on each of the surfaces exposed to the exterior in the awning embodiments, casement embodiments, and hopper embodiments detailed above or any other embodiment contemplated by the present disclosure. A wide variety of material choices for the panes in these embodiments are contemplated by the present disclosure. The present disclosure contemplates any transparent or translucent material suitable for use in a window (glass, plastic, ceramic, vinyl, among others without limitation). The present disclosure contemplates that it may be desired to reduce the amount of light which enters the interior of a building. In such cases, the present disclosure contemplates the use of light reduction techniques including tinted glass, auto-darkening, and smart glass (electrochromic, photochromic, thermochromic, suspended particle, micro-blind and polymer dispersed liquid crystal devices, among others) without limitation. Insulated glazing or double glazing is a method by which multiple glass panes are separated by a vacuum or gas filled space to reduce the heat transfer rate across the panes. Double glazed windows additionally help to reduce the noise transmitted across the panes by adding a layer of insulation. The present disclosure anticipates that it may be desired to employ such techniques and contemplates the use of at least two panes lined concentrically in a single surface separated by vacuum or gas filled space.

There are many ways in which the present embodiments can be built or constructed. Therefore, it should be understood that the above description of the invention and specific embodiments, while indicating preferred embodiments of the present invention are given by way of illustration and not limitation. Many changes and modifications within the scope of the present invention may be made without departing from the spirit thereof, and the present invention includes all such changes and modifications. For example, the number of folding panels and/or the number of panes extending beyond a building's facade may be readily modified.

What I claim is:

1. A structure integrated into an outer wall of a building comprising:

a frame having an interior and an exterior, said frame secured and positioned in a wall opening located in the outer wall;

a first movable member, wherein an upper portion of the first movable member is movably attached to a first side of the interior of the frame;

a second movable member opposite the first movable member, wherein an upper portion of the second movable member is movably attached to a second side of the interior of the frame;

a bottom member, wherein at least a portion of the bottom member is permanently secured to a bottom portion of each of the first and second movable members; and a sash member permanently secured to the first and second movable members and to the bottom member, wherein said structure is in a position selected from the group consisting of an extended position providing a weight-bearing enclosure beyond the outer wall of said building, a retracted position, and an intermediate position between said extended position and said retracted position.

2. The structure of claim 1, wherein the interior of said frame has a top and a bottom portion, said first and second movable members further comprise a side facing said frame and a side facing away from said frame; and said movable attachments comprise a first pivotal attachment between said frame and said first movable member, and a second pivotal attachment between said frame and said second movable member, each of said pivotal attachments being near the top of the interior of the frame.

3. The structure according to claim 1, wherein said bottom member further comprises a first and a second portion, said first portion of said bottom member being permanently secured to a lower portion of said first and second movable members, and said first and second portions of said bottom member are connected by a rotatable joint about which said second portion is rotatable into a position on top of a part of said first portion.

4. The structure according to claim 1, wherein said bottom member further comprises a first and a second portion, said first portion of said bottom member being permanently secured to a lower portion of said first and second movable members, and said second portion of said bottom member is detachably connected to said first portion of said bottom member.

5. The structure according to claim 1, wherein each of said first and second members further comprise a portion that is detachably connected to the other member.

6. The structure according to claim 1 in which said building has an interior and an exterior, in which at least one of said first and second members further comprises a portion connected to at least one of said first and second members by a rotatable joint to admit air to flow between the exterior and the interior of said building.

7. A structure integrated into an outer wall of a building, said building having an interior and an exterior, said structure comprising:

a frame comprising a top, a first and a second interior side as well as a windowsill, said frame being secured and positioned in a wall opening located in the outer wall;

a first movable member, wherein an upper portion of the first movable member is rotatably attached to the first interior side of the frame;

a second movable member opposite the first movable member, wherein an upper portion of the second movable member is rotatably attached to the second interior side of the frame;

a bottom member, having a first and a second portion wherein the first portion of said bottom member is rotatably secured to a bottom portion of each of the first and second movable members;

a sash member permanently secured to the first and second movable members;

a window track mounted to the exterior of the outer wall below the windowsill, said second portion of said bottom member comprising a track connection member that movably connects to said window track;

wherein said movable track connection member of said second portion of said bottom member is translatable along said window track.

8. The structure of claim 7 wherein said window track is mounted indirectly to the exterior of the outer wall of said building.

9. A structure integrated into an outer wall of a building comprising:

a frame comprising a top, a first and a second interior side as well as a windowsill, said frame being secured and positioned in a wall opening located in the outer wall;

a first movable member, said first movable member having an upper portion rotatably attached to the first interior side of the frame, and a lower portion below said upper portion;

a second movable member opposite the first movable member, said second movable member having an upper portion rotatably attached to the second interior side of the frame, and a lower portion below said upper portion;

a bottom member having perimeter edges, wherein at least a portion of the bottom member is permanently secured to said lower portion of each of said first and second movable members;

a sash member permanently secured to the first and second movable members and to the bottom member; and an upper seat member having upper and lower ends connected to said lower portions of said first and second movable members and to the perimeter edge of said bottom member furthest from the perimeter edge of said bottom member joined to said sash member, wherein said structure is positioned in at least one position selected from the group consisting of an extended position providing a weight-bearing enclosure beyond the outer wall of said building, and a retracted position.

10. The structure of claim 9 further comprises a removable lower seat member, said removable lower seat member removably connects to the lower end of said upper seat member.

11. A structure included in an outer wall of a building comprising:

a frame comprising a top side member, a right-side member, a left-side member, and a bottom side member, said frame secured and positioned in an opening in said outer wall; a first expansion unit, said first expansion unit comprising:

a left-side member of said first expansion unit, a top side member of said first expansion unit, a right-side member of said first expansion unit, and a bottom member of said first expansion unit;

wherein said left-side member of said first expansion unit is connected by a first weatherproof seal to said left side member of said frame, said top side member of said first expansion unit is connected by a second weatherproof seal to said top side member of said frame, said right-side member of said first expansion unit is connected by a third weatherproof seal to said right-side member of said frame, and said bottom side member of said first expansion unit is connected by a fourth weatherproof seal to said top bottom side member of said frame, a second expansion unit, said second expansion unit comprising: a left-side member of said second expansion unit, a top side member of said second expansion unit, a right-side member of second expansion unit, and a bottom member of said second expansion unit;

wherein said left-side member of said second expansion unit is connected by a fifth weatherproof seal to said left side member of first expansion unit, said top side member of said second expansion unit is connected by a sixth weatherproof seal to said top side member of first expansion unit, said right-side member of said second expansion unit is connected by a seventh weatherproof seal to said right-side member side member of first expansion unit, and said bottom side member of said second expansion unit is connected by a eighth weatherproof seal to said top bottom side member of side member of first expansion unit, a sash member connected by a ninth weatherproof seal to said right side member, said top member, said left-side member, and said bottom member of said second expansion unit;

said second expansion unit is movably mounted inside said first expansion unit in a manner that permits reversable movement of said second expansion unit from a retracted position within said first expansion unit to an extended position wherein said second expansion unit extends beyond the first expansion unit;

said first expansion unit is movably mounted inside said frame in a manner that permits reversable movement of said first expansion unit from a retracted position within said frame to an extended position wherein said first expansion unit extends beyond the frame;

wherein said first and second expansion units are configured to support a user's weight beyond said outer wall in the extended position of said first and second expansion units.

12. The structure of claim 11 further comprising an inward edge of said first expansion unit adapted to interact with an outward edge of said second expansion unit to limit the movement of said second expansion unit.

13. A structure included in an outer wall of a building comprising:

a frame secured and positioned in an opening in said outer wall;

a first expansion unit having an interior and an exterior, wherein said first expansion unit comprises a left side member, a top side member, a right side member and a bottom side member, wherein the left side member, the top side member, the right side member, and the bottom side member of said first expansion member are movably connected to said frame for translation of the first expansion unit between a retracted position and an extended position at least partially outside of the building;

a second expansion unit movable about a connection to said first expansion unit, the second expansion unit having a left side, a top side, a right side and a bottom side members, wherein the left side, the top side, the right side, and the bottom side members of the second expansion unit are movably connected to the interior of said first expansion unit, and said left side, top side, right side and bottom side members of the second expansion unit form a weatherproof seal with the first expansion unit, wherein the second expansion unit is mounted to move between a nested position in which said second expansion unit is nested within the first expansion unit and a tilted position in which said second expansion unit is tilted outward of the first expansion unit, wherein at said first expansion unit is configured to at least partially support a user's weight in an instance in which the structure is in an extended position beyond the outer wall of the building; and a sash member permanently secured to the left side member, the top side, the bottom side member, and the right side member of the second unit.

* * * * *